US010441010B2

(12) United States Patent
Pasko et al.

(10) Patent No.: US 10,441,010 B2
(45) Date of Patent: Oct. 15, 2019

(54) DISPOSABLE MEDICAL GOWN

(75) Inventors: Stephanie Pasko, Des Plaines, IL (US); Atieno Ouma, New York, NY (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 13/276,232

(22) Filed: Oct. 18, 2011

(65) Prior Publication Data

US 2013/0091615 A1 Apr. 18, 2013

(51) Int. Cl.
*A41D 13/12* (2006.01)

(52) U.S. Cl.
CPC ..... *A41D 13/12* (2013.01); *A41D 2400/44* (2013.01)

(58) Field of Classification Search
USPC ..... 2/48, 49.5, 69, 69.5, 70, 75, 104, 114, 2/119, 121, 136; D2/720
See application file for complete search history.

(56) References Cited

U.S. PATENT DOCUMENTS

| | | | |
|---|---|---|---|
| 313,046 | A | 3/1885 | Batdorf |
| 371,353 | A | 10/1887 | Perry |
| 842,224 | A | 1/1907 | Mills |
| 850,960 | A | 4/1907 | O'Connor |
| 884,063 | A | 4/1908 | Baldwin |
| 1,506,332 | A | 8/1924 | Bloom |
| 1,980,435 | A | 11/1934 | Reagan |
| D108,151 | S | 1/1938 | Cairns |
| 2,172,162 | A | 8/1939 | Gillette |
| 2,292,347 | A | 8/1942 | Bailey |
| D136,385 | S | 9/1943 | Pons |
| D136,386 | S | 9/1943 | Pons |
| 2,374,643 | A | 5/1945 | Boettcher |
| D146,506 | S | 3/1947 | Kenny |
| 2,430,941 | A | 11/1947 | Long |

(Continued)

FOREIGN PATENT DOCUMENTS

| | | |
|---|---|---|
| CA | 2343482 | 10/2001 |
| CA | 2799116 | 8/2013 |

(Continued)

OTHER PUBLICATIONS

Vanatta, Amy "Non-Final Office Action", U.S. Appl. No. 12/720,360, filed Mar. 9, 2010; dated Oct. 11, 2011.

(Continued)

*Primary Examiner* — Sally Haden
(74) *Attorney, Agent, or Firm* — Philip H. Burrus, IV

(57) ABSTRACT

A disposable medical gown (100) includes a body covering portion (101) and optionally one or more sleeves (107,108). The body covering portion (101) defines a head insertion aperture (104) between a frontal body covering portion (103) configured to cover a frontal body portion of a wearer and a rear portion (203) configured to cover at least parts of shoulder blades of the wearer. A torso opening (201) is disposed on a side of the rear portion (203) opposite the head insertion aperture (104), and extends distally from the rear portion (203). One or more perforations (202) extend across the rear portion (203) at least partially between the torso opening (202) and the head insertion aperture (104), and facilitate easy removal of the gown (100). A user removes the gown (100) by pulling the front portion (103), thereby tearing the perforations.

13 Claims, 25 Drawing Sheets

(56) References Cited

U.S. PATENT DOCUMENTS 2,431,466 A 11/1947 Barri
2,556,931 A 6/1951 Miller
2,653,324 A 8/1953 McMahon
2,668,294 A 2/1954 Gilpin
2,673,347 A 3/1954 Weiss
2,825,902 A 3/1958 Breier
D193,132 S 7/1962 Rhoads et al.
3,129,432 A 4/1964 Belkin
3,144,661 A 8/1964 Buser
3,229,305 A 1/1966 Nevitt
3,276,036 A * 10/1966 Cater et al. ..... 2/114
D208,527 S 9/1967 Grengg
3,359,569 A 12/1967 Scrivens
3,397,406 A 8/1968 Leach
3,399,406 A 9/1968 Bradley
3,429,433 A 2/1969 Holt
3,451,062 A 6/1969 Bradley
3,540,441 A 11/1970 Collins
3,625,206 A 12/1971 Charnley
3,696,443 A 10/1972 Taylor
3,707,964 A 1/1973 Patience et al.
3,721,997 A 3/1973 Mundt
3,721,999 A 3/1973 Goya et al.
3,803,640 A 4/1974 Ericson
3,824,625 A 7/1974 Green
D233,634 S 11/1974 Snider
3,858,243 A 1/1975 Pierron et al.
3,868,728 A 3/1975 Krzewinski
3,881,476 A 5/1975 Bolker et al.
D236,293 S 8/1975 Banks
3,921,221 A 11/1975 Zoephel
3,935,596 A 2/1976 Allen, Jr. et al.
3,952,373 A 4/1976 Noorily
3,968,792 A 7/1976 Small
3,989,040 A 11/1976 Lofgren et al.
4,000,521 A 1/1977 Zoephel et al.
4,017,909 A 4/1977 Brandriff
4,040,124 A 8/1977 Zoephel
4,119,093 A 10/1978 Goodman
4,119,095 A 10/1978 Lewis
4,153,054 A 5/1979 Boone
4,171,542 A 10/1979 Cox et al.
D254,276 S 2/1980 Behrmann
4,214,320 A 7/1980 Belkin
RE30,520 E 2/1981 Pierron
4,290,148 A 8/1981 Roberts
4,308,864 A 1/1982 Small et al.
D267,830 S 2/1983 Arnseth et al.
4,384,573 A 5/1983 Elliott
4,408,357 A 10/1983 Toth
2,449,584 A 9/1984 Briton
4,476,587 A 10/1984 Itoi
4,476,860 A 10/1984 Collins et al.
4,504,977 A 3/1985 King et al.
4,523,335 A 6/1985 Scrivens
4,535,481 A 8/1985 Ruth-Larson et al.
4,561,126 A 12/1985 Truman
4,569,341 A 2/1986 Morris
4,570,268 A 2/1986 Freeman
4,622,699 A 11/1986 Spriggs
4,631,756 A 12/1986 Scrivens
4,653,120 A 3/1987 Leaf
4,674,132 A 6/1987 Stein et al.
4,686,715 A 8/1987 Price
4,705,171 A 11/1987 Eldridge
4,718,124 A 1/1988 Sawicki et al.
4,736,467 A 4/1988 Schwarze et al.
4,783,854 A 11/1988 Bjorklund
4,829,602 A 5/1989 Harreld et al.
D305,376 S 1/1990 Russell
D305,575 S 1/1990 Gordon et al.
4,905,710 A 3/1990 Jones
4,920,578 A * 5/1990 Janzen et al. ..... 2/114
4,942,987 A 7/1990 Stackhouse
4,951,317 A 8/1990 Gray et al.
4,951,318 A 8/1990 Harreld et al.
4,964,173 A 10/1990 Gordon
4,969,215 A 11/1990 Burkett
5,010,592 A 4/1991 Skiles, Jr.
5,027,438 A 7/1991 Schwarze et al.
5,029,344 A 7/1991 Shannon et al.
5,033,115 A 7/1991 Bowling et al.
D319,113 S 8/1991 Adams
5,042,507 A 8/1991 Dowdy
5,061,246 A 10/1991 Anapliotis
5,063,919 A 11/1991 Silverberg
5,074,316 A 12/1991 Dowdy
5,088,116 A 2/1992 Gould
5,097,534 A 3/1992 Viemeister et al.
5,135,188 A 8/1992 Anderson et al.
5,136,758 A 8/1992 Wilcox et al.
5,184,351 A 2/1993 Benstock
5,271,100 A 12/1993 Holt
D348,974 S 7/1994 Whitwill
D351,712 S 10/1994 Jackson
5,362,306 A 11/1994 McCarver et al.
5,372,589 A 12/1994 Davis
5,377,387 A 1/1995 Freed
D356,204 S * 3/1995 Derrickson ..... D2/720
5,410,758 A 5/1995 Dupont et al.
5,414,867 A 5/1995 Bowling et al.
5,444,871 A 8/1995 Lopez
5,444,872 A 8/1995 Johnson
5,444,873 A 8/1995 Levin
D362,331 S 9/1995 Berger, II
5,454,119 A 10/1995 Thomm
5,533,209 A 7/1996 Davis
D374,113 S 10/1996 Console
5,561,861 A 10/1996 Lopez et al.
5,575,006 A 11/1996 Wolfe
5,605,534 A 2/1997 Hutchison
5,674,189 A 10/1997 McDowell et al.
5,694,643 A 12/1997 Fujiwara
5,707,703 A 1/1998 Rothrum et al.
5,768,707 A 6/1998 Lederer
5,784,718 A 7/1998 Finnegan
5,806,094 A 9/1998 Kasun et al.
5,813,051 A 9/1998 Counter
5,813,052 A 9/1998 Taylor
5,862,525 A 1/1999 Tankersley et al.
5,867,825 A 2/1999 Scheerer
5,985,395 A 11/1999 Comstock et al.
D419,748 S 2/2000 Sartori
6,049,907 A 4/2000 Palomo
6,062,444 A 5/2000 Tankersley et al.
6,115,840 A * 9/2000 Hastings ..... 2/114
D431,344 S 10/2000 Briceno
6,138,278 A 10/2000 Taylor
6,196,033 B1 3/2001 Dowdle
6,216,270 B1 * 4/2001 Moquin et al. ..... 2/69
6,235,659 B1 5/2001 McAmish et al.
6,272,685 B1 * 8/2001 Kumar ..... 2/114
6,378,136 B2 * 4/2002 Matsushita ..... 2/114
D463,093 S 9/2002 Murray
6,449,772 B1 9/2002 Donner
D469,945 S 2/2003 Mayer
6,536,636 B1 3/2003 McDonniel
6,564,386 B2 5/2003 Fujikawa et al.
6,601,239 B2 8/2003 Drake
6,665,880 B2 12/2003 Poppe
6,694,981 B2 2/2004 Gingles et al.
6,990,686 B2 1/2006 Palmer
D533,982 S 12/2006 Graneto, III
7,181,773 B1 * 2/2007 Piraka ..... 2/114
7,237,271 B1 7/2007 McLandrich
D563,627 S 3/2008 Warren
D565,279 S 4/2008 Ferrell
7,370,369 B2 5/2008 Cheung
7,412,728 B2 8/2008 Alesina et al.
D575,936 S 9/2008 Fenderson et al.
D579,178 S 10/2008 Snyder et al.
7,454,798 B2 * 11/2008 Feodoroff ..... 2/114
D584,483 S 1/2009 Glynn
7,549,179 B1 * 6/2009 Saied ..... 2/51

(56) References Cited

U.S. PATENT DOCUMENTS

| | | | |
|---|---|---|---|
| D598,638 | S | 8/2009 | Graneto, III |
| 7,594,279 | B2 | 9/2009 | Roy |
| D608,980 | S | 2/2010 | Brady |
| 7,654,266 | B2 | 2/2010 | Corbitt, Jr. |
| D612,126 | S | 3/2010 | Milgrom |
| D618,884 | S | 7/2010 | Zhu |
| D622,479 | S | 8/2010 | Herzog |
| D622,934 | S | 9/2010 | Graneto, III |
| 7,819,911 | B2 | 10/2010 | Anderson et al. |
| 7,841,020 | B2 | 11/2010 | Mayfield et al. |
| 7,926,120 | B2 | 4/2011 | Birmingham |
| 7,971,274 | B2 | 7/2011 | Graneto, III |
| 8,006,836 | B2 | 8/2011 | Trombetta |
| D646,463 | S | 10/2011 | Petrovskis et al. |
| D647,688 | S | 11/2011 | Hilgart |
| 8,056,146 | B2 | 11/2011 | Porowski |
| 8,069,495 | B2 | 12/2011 | Kemper |
| D653,019 | S | 1/2012 | Bond |
| D655,479 | S | 3/2012 | Umbach et al. |
| D657,530 | S | 4/2012 | Farris et al. |
| 8,162,137 | B2 | 4/2012 | Vellutato, Jr. et al. |
| 8,286,263 | B2 | 10/2012 | Sampson-Howlett |
| 8,332,965 | B1 | 12/2012 | Ryer |
| 8,375,466 | B2 * | 2/2013 | Tasezen et al. ..... 2/69 |
| D680,709 | S | 4/2013 | Blood |
| 8,464,374 | B1 | 6/2013 | Thayer |
| D687,209 | S | 8/2013 | Levine |
| D690,078 | S | 9/2013 | Anderson |
| D698,529 | S | 2/2014 | Vanneste |
| 8,677,513 | B2 | 3/2014 | Mathis et al. |
| D719,721 | S | 12/2014 | Bonfiglio |
| D721,870 | S | 2/2015 | Levine |
| D736,493 | S | 8/2015 | Pasko |
| D737,546 | S | 9/2015 | Sewall |
| D741,044 | S | 10/2015 | Pasko |
| 9,330,799 | B1 | 5/2016 | Phillips |
| D774,729 | S | 12/2016 | Pasko |
| D779,155 | S | 2/2017 | Pasko et al. |
| D779,156 | S | 2/2017 | Pasko |
| D785,284 | S | 5/2017 | Pasko |
| D787,780 | S | 5/2017 | Pasko |
| D791,434 | S | 7/2017 | Pasko |
| D792,056 | S | 7/2017 | Reese et al. |
| D836,297 | S | 12/2018 | Pasko |
| 2001/0032346 | A1 | 10/2001 | Matsushita et al. |
| 2002/0095709 | A1 | 7/2002 | Fujikawa et al. |
| 2003/0121522 | A1 | 7/2003 | Gingles et al. |
| 2003/0131401 | A1 | 7/2003 | Dilworth |
| 2004/0019951 | A1 | 2/2004 | Cioffi |
| 2004/0103904 | A1 | 6/2004 | Auerbach et al. |
| 2004/0123366 | A1 | 7/2004 | Schorr et al. |
| 2005/0044608 | A1 | 3/2005 | Ambrose et al. |
| 2005/0132465 | A1 | 6/2005 | Kathumbi-Jackson et al. |
| 2005/0223468 | A1 | 10/2005 | Hatton |
| 2006/0000002 | A1 | 1/2006 | Bergkvist |
| 2006/0064797 | A1 | 3/2006 | Pyeatt Rowe |
| 2006/0107434 | A1 | 5/2006 | Rowe |
| 2006/0117452 | A1 | 6/2006 | Ambrose |
| 2006/0117456 | A1 | 6/2006 | Griesbach |
| 2006/0177655 | A1 | 8/2006 | Mizohata et al. |
| 2006/0236440 | A1 | 10/2006 | Zahler |
| 2006/0277655 | A1 | 12/2006 | Kerr |
| 2006/0286334 | A1 | 12/2006 | Harpole |
| 2007/0130668 | A1 | 6/2007 | Berman et al. |
| 2008/0006279 | A1 | 1/2008 | Bodenham et al. |
| 2008/0115253 | A1 | 5/2008 | Gorman |
| 2008/0155728 | A1 | 7/2008 | Hafer et al. |
| 2008/0178365 | A1 | 7/2008 | Furgerson et al. |
| 2009/0165186 | A1 | 7/2009 | Mijares et al. |
| 2009/0320177 | A1 | 12/2009 | Lin et al. |
| 2010/0031966 | A1 | 2/2010 | Allen |
| 2010/0064408 | A1 | 3/2010 | Kemper |
| 2010/0138975 | A1 | 6/2010 | Jordan et al. |
| 2010/0212063 | A1 | 8/2010 | Baucom et al. |
| 2010/0299805 | A1 | 12/2010 | Graneto, III |
| 2010/0300459 | A1 | 12/2010 | Lair |
| 2011/0023210 | A1 | 2/2011 | Porowski |
| 2011/0024485 | A1 | 2/2011 | Porowski |
| 2011/0154554 | A1 | 6/2011 | Furlong |
| 2011/0167534 | A1 | 7/2011 | Wong et al. |
| 2011/0231981 | A1 | 9/2011 | Appel et al. |
| 2011/0315150 | A1 | 12/2011 | Bream, Jr. |
| 2012/0047623 | A1 | 3/2012 | van Oudenallen et al. |
| 2012/0054940 | A1 | 3/2012 | Halseth |
| 2012/0060257 | A1 | 3/2012 | Herzog |
| 2012/0124722 | A1 | 5/2012 | Yadav et al. |
| 2012/0305541 | A1 | 12/2012 | Giles |
| 2012/0312308 | A1 | 12/2012 | Allen |
| 2013/0091615 | A1 | 4/2013 | Pasko et al. |
| 2013/0091616 | A1 | 4/2013 | Muche et al. |
| 2013/0191960 | A1 | 8/2013 | Pasko |
| 2013/0198930 | A1 | 8/2013 | Levine |
| 2013/0276204 | A1 | 10/2013 | Pasko et al. |
| 2013/0318682 | A1 | 12/2013 | Graneto, III |
| 2014/0007316 | A1 | 1/2014 | Tommarello et al. |
| 2014/0082816 | A1 | 3/2014 | Christopher |
| 2014/0173814 | A1 | 6/2014 | Yadav et al. |
| 2014/0182043 | A1 | 7/2014 | Moore |
| 2014/0189931 | A1 | 7/2014 | Fredrickson |
| 2014/0215681 | A1 | 8/2014 | Goodman |
| 2015/0089712 | A1 | 4/2015 | Gamble |
| 2015/0096099 | A1 | 4/2015 | Vanneste |
| 2015/0113698 | A1 | 4/2015 | Gregerson-Brown |
| 2015/0135397 | A1 | 5/2015 | Levine |
| 2015/0135398 | A1 | 5/2015 | Czajka et al. |
| 2015/0208741 | A1 | 7/2015 | Pasko |
| 2015/0213215 | A1 | 7/2015 | Kobayashi et al. |
| 2018/0343940 | A1 | 12/2018 | Genender |

FOREIGN PATENT DOCUMENTS

| | | |
|---|---|---|
| CN | 302083878 | 9/2012 |
| DE | 10200902499 | 12/2010 |
| DE | 102011016497 | 10/2015 |
| EM | 001320857 | 3/2012 |
| EP | 143204 | 6/1985 |
| EP | 0335041 | 10/1989 |
| EP | 335041 | 10/1989 |
| EP | 1362520 | 11/2003 |
| EP | 1407324-0001 | 5/2014 |
| EP | 1407324-0002 | 5/2014 |
| EP | 1407324-0003 | 5/2014 |
| EP | 1407324-0004 | 5/2014 |
| FR | 2709643 | 3/1995 |
| KR | 101116311 | 3/2012 |
| WO | WO-2008/146138 | 12/2008 |
| WO | 2014159401 | 10/2014 |

OTHER PUBLICATIONS

Harris, Raymond E., "Non-Final Office Action", U.S. Appl. No. 12/537,961, filed Aug. 7, 2009; dated Nov. 9, 2011.

Vanatta, Amy B., "Notice of Allowance", U.S. Appl. No. 12/720,360, filed Mar. 9, 2012; dated Feb. 9, 2012.

Harris, Raymond E., "Final Office Action", U.S. Appl. No. 12/537,961, filed Aug. 7, 2009; dated Apr. 11, 2012.

Harris, Raymond E., "NonFinal OA", U.S. Appl. No. 12/537,961, filed Aug. 17, 2009; dated Jul. 17, 2012.

Lee, Cheol Soo "International Search Report", PCT/US2012/032122, Filed Apr. 4, 2012; dated Nov. 1, 2012.

Harris, Raymond E., "Final OA", U.S. Appl. No. 12/537,961, filed Aug. 7, 2009; dated Nov. 21, 2012.

Byun, Sung C., "PCT Search Report", PCT No. PCT/US2012/052079; Filed Aug. 23, 2012; dated Dec. 26, 2012.

Hicks, Victoria "NonFinal OA", U.S. Appl. No. 13/116,473, filed May 26, 2011; dated May 16, 2013.

Haden, Sally C., "NonFinal OA", U.S. Appl. No. 13/925,617, filed Jun. 24, 2013; dated Aug. 14, 2013.

Haden, Sally C., "Final OA", U.S. Appl. No. 13/925,617, filed Jun. 24, 2013; dated Aug. 14, 2013.

Fitts, Carissa "NonFinal OA", U.S. Appl. No. 29/404,295, filed Oct. 18, 2011; dated Jul. 1, 2014.

(56) References Cited

OTHER PUBLICATIONS

Lee, Jong Kyung "PCT Search Report and Written Opinion", PCT/US2014/023432; Filed Mar. 11, 2014; dated Jul. 10, 2014.
Haden, Sally C., "NonFinal OA", U.S. Appl. No. 13/925,617, filed Jun. 24, 2013; dated Aug. 13, 2014.
Fitts, Carissa "NonFinal OA", U.S. Appl. No. 29/404,296, filed Oct. 8, 2011; dated Oct. 9, 2014.
Blue Medical Gown; Manufactured by Medline Industries, Inc.; Unknown availability date but believed to be prior to 1999.
Fitts, Carissa "Final OA", U.S. Appl. No. 29/404,295, filed Oct. 18, 2011; dated Feb. 19, 2015.
McVey, Lauren "NonFinal OA", U.S. Appl. No. 29/459,047, filed Jun. 25, 2013; dated Apr. 23, 2015.
McVey, Lauren "Notice of Allowance", U.S. Appl. No. 29/459,060, filed Jun. 25, 2013; dated Apr. 23, 2015.
McVey, Lauren D., "NonFinal OA", U.S. Appl. No. 29/467,619, filed Sep. 20, 2013; dated May 20, 2015.
"Publication", Fashion Flats by Garment Element; By Art Design Projects Inc.; www.fashioncroquis.com; visited May 21, 2015; types of raglan sleeves.
Fashion Flats, <URLL http:fashion-flats.com/images/1_details_set_in_sleeves_.jpr> Visited by Examiner May 21, 2015; Types of set-in sleeves.
The visual dictionary. <RURL: http://www.infovisual.info/06/049_en.html> Jun. 1, 2013. types of cuffs.
McVey, Lauren "NonFinal OA", U.S. Appl. No. 29/467,612, filed Sep. 20, 2013; dated Jun. 5, 2015.
McVey, Lauren "Notice of Allowance", U.S. Appl. No. 29/467,620, filed Sep. 20, 2013; dated Jun. 23, 2015.
McVey, Lauren "NonFinal OA", U.S. Appl. No. 29/467,603, filed Sep. 30, 2015, dated Jun. 30, 2015.
Fitts, Carissa "Final OA", U.S. Appl. No. 29/404,296, filed Oct. 18, 2011; dated Jul. 2, 2015.
McVey, Lauren "NonFinal OA", U.S. Appl. No. 29/467,625, filed Sep. 20, 2013; dated Jul. 29, 2015.
McVey, Lauren "NonFinal OA", U.S. Appl. No. 29/467,616, filed Sep. 20, 2013; dated Jun. 17, 2015.
Cline, Sally "Restriction Req", U.S. Appl. No. 13/804,565, filed Mar. 14, 2013; dated Aug. 13, 2015.
McVey, Lauren "NonFinal OA", U.S. Appl. No. 29/467,621, filed Sep. 20, 2013; dated Aug. 26, 2015.
Wu, Jocelyn Mary "NonFinal OA", U.S. Appl. No. 14/086,798, filed Nov. 21, 2013; dated Sep. 24, 2015.
McVey, Lauren "Final OA", U.S. Appl. No. 29/459,047, filed Jun. 25, 2013; dated Sep. 24, 2015.
McVey, Lauren "Final OA", U.S. Appl. No. 29/467,619, filed Sep. 20, 2013; dated Oct. 20, 2015.
Haden, Sally C., "NonFinal OA", U.S. Appl. No. 13/804,565, filed Mar. 14, 2013; dated Oct. 29, 2015.
McVey, Lauren "Final OA", U.S. Appl. No. 29/467,616, filed Sep. 20, 2013; dated Nov. 3, 2015.
Haden, Sally "NonFinal OA", U.S. Appl. No. 13/925,598, filed Jun. 24, 2013; dated Dec. 15, 2015.
Fitts, Carissa "NonFinal OA", U.S. Appl. No. 29/467,622, filed Sep. 20, 2013; dated Dec. 30, 2015.
Haden, Sally "NonFinal OA", U.S. Appl. No. 13/925,532, filed Jun. 24, 2013; dated Jan. 8, 2016.
Fitts, Carissa "NonFinal OA", U.S. Appl. No. 29/467,623, filed Sep. 20, 2013; dated Jan. 13, 2016.
Walshon, Rashida "NonFinal OA", U.S. Appl. No. 29/506,290, filed Oct. 14, 2014; dated Jan. 20, 2016.
"Final OA", U.S. Appl. No. 14/086,798, filed Nov. 21, 2013; dated Feb. 1, 2016.
Rakuten. <URL: http://global.rakuten.com/en/store/753ya/item/100131328/[2/4/2016%201:51:48%20PM]>. Visited Feb. 4, 2016. Hada-Juban.
Vintage Patterns Wikia. <URL: https//vintagepatterns.wikia.com/wiki/Butterikc_5374.> visited Dec. 9, 2015. Butterick 5374—Vintage Sewing Blouse Pattern.
Jendela Sastra. <URL: http://www.jendelasatra.com/karya/puisi/hadajuban-dalam-kimono>. Poem with picture published Jan. 10, 2014. Hadajuban (first layer of kimono).
Sakura-San. <URL: http://www.sakura-san.de/Juban.htm> Saved Jul. 12, 2013. Juban Furisode and Hada-Juban layers for kimono.
Go Japan Go. <URL: http://www.gojapangp.com/fashion/hadajuban_kimono.html>. Visited Feb. 4, 2016. Hadajuban.
McVey, Lauren "Final OA", U.S. Appl. No. 29/467,603, filed Sep. 20, 2013; dated Feb. 10, 2016.
Disposable Medical Gown; Elastic Cuffs; Salamint, posted at salaaming.com, posting date n/a, copyright 2015 salamin.com, online, site visit Mar. 11, 2016; Available from https://www.salamint.com/productdetail.aspx?id=358.
Wright, Jennifer "NonFinal OA", U.S. Appl. No. 29/506,294, filed Oct. 14, 2014; dated Mar. 28, 2016.
Disposable Medical Gown; Thumb Loop Plastic Disposable Medical Surgical Gown, posting date n/a, copyright 1999-2016 alibaba.com; site visited Mar. 11, 2016, available from http://www.alibaba.com/product-detail/CPE-Gown-Thumb-loop-White-color_60043196775.html.
McVey, Lauren "Final OA", U.S. Appl. No. 29/467,621, filed Sep. 20, 2013; dated Apr. 11, 2016.
Fitts, Carissa "NonFinal OA", U.S. Appl. No. 29/404,296, filed Oct. 18, 2011; dated Apr. 22, 2016.
Definition of Progressive. Merriam-Webster. Merriam-Webster, n.d. Web. May 17, 2016.
Haden, Sally C., "Final OA", U.S. Appl. No. 13/804,565, filed Mar. 14, 2013; dated May 19, 2016.
Haden, Sally Cline "NonFinal OA", U.S. Appl. No. 13/925,532, filed Jun. 24, 2013; dated May 23, 2016.
Haden, Sally Cline "NonFinal OA", U.S. Appl. No. 13/925,598, filed Jun. 23, 2013; dated May 24, 2016.
Fitts, Carissa "Final OA", U.S. Appl. No. 29/467,622, filed Sep. 20, 2013; dated Jul. 12, 2016.
Walshon, Rashida "Final OA", U.S. Appl. No. 29/506,290, filed Oct. 14, 2014, dated Jul. 28, 2016.
McVey, Lauren "Notice of Allowance", U.S. Appl. No. 29/467,616, filed Sep. 20, 2013; dated Aug. 10, 2016.
McVey, Lauren "Notice of Allowance", U.S. Appl. No. 29/459,047, filed Jun. 25, 2013; dated Aug. 10, 2016.
McVey, Lauren "Notice of Allowance", U.S. Appl. No. 29/467,623, filed Sep. 20, 2013; dated Aug. 30, 2016.
Haden, Sally "Final OA", U.S. Appl. No. 13/925,598, filed Jun. 24, 2013; dated Sep. 6, 2016.
Wright, Jennifer "NonFinal OA", U.S. Appl. No. 29/506,294, filed Oct. 14, 2014; dated Sep. 23, 2016.
Haden, Sally Cline "Final OA", U.S. Appl. No. 13/925,532, filed Jun. 24, 2013; dated Sep. 26, 2016.
Fitts, Carissa "Notice of Allowance", U.S. Appl. No. 29/404,296, filed Oct. 18, 2011; dated Oct. 7, 2016.
McVey, Lauren "Notice of Allowance", U.S. Appl. No. 29/459,047, filed Jun. 25, 2013; dated Oct. 19, 2016.
McVey, Lauren "Notice of Allowance", U.S. Appl. No. 29/467,621, filed Sep. 20, 2013; dated Oct. 20, 2016.
Mcvey, Lauren , "NonFinal OA", U.S. Appl. No. 20/545,806; filed Nov. 16, 2015; dated May 3, 2019,.
Walshon, Rashida , "Notice of Allowance", U.S. Appl. No. 29/591,354; filed Jan. 19, 2017; dated 19JE2019.
Country Living down under. <URL: http://countrylivingdownunder.yuku.com/topic/6395/How-to-attach-elastic-to-gather-andto-shit#.WQCbi_krJaQ.> Jun. 2nd, 2014. Gathering with elastic.
Lyst. <URL: https://ww.lyst.com/clothing/chritophe-lemaire-yak-hair-wool-thumbhole-sweater-moss-stone/.> Visited Apr. 26, 2017 by Examiner of U.S. Appl. No. 29/545,806; Chritophe Lemaire Thumbhole Sweater.
"BurdaStyle Women's Size Chart", http://www.burdastyle.com/downloads/SizeChart_Regular_inches.pdf; Publication Date Unknown.
Fitts, Carissa , "Final OA", U.S. Appl. No. 29/536,646; filed Aug. 18,.2015; dated.Oct. 4, 2017.
Fitts, Carissa , "NonFinal OA", U.S. Appl. No. 29/467,622; filed Sep.20, 2013; dated May 2, 2017.
Fitts, Carissa , "NonFinal OA", U.S. Appl. No. 29/536,646; filed Aug. 18, 2015; datedJun. 27, 2017.

(56) References Cited

OTHER PUBLICATIONS

Fitts, Carissa , "Notice of Allowance", U.S. Appl. No. 29/467,622; filed Sep. 20, 2013; dated Sep. 26, 2017.
Fitts, Carissa , "Notice of Allowance", U.S. Appl. No. 29/536,646; filed Aug. 18, 2015; dated Jul. 3, 2018.
Fitts, Carissa C , "Notice of Allowance", U.S. Appl. No. 29/467,623; Filed Sep. 20, 2013; dated Jan. 13, 2017.
Haden, Sally , "Appeal Decision", U.S. Appl. No. 13/804,565; filed Mar. 14, 2013; dated Jan. 8, 2019.
Haden, Sally , "Appeal Decision", U.S. Appl. No. 13/925,532; filed Jun. 24, 2013; dated Jan. 8, 2019.
Haden, Sally , "Appeal Decision", U.S. Appl. No. 13/925,598; filed Jun. 24, 2013; dated Sep. 7, 2018.
Haden, Sally , "Appeal Decision", U.S. Appl. No. 13/925,617; filed Jun. 24, 2013; dated Jun. 6, 2017.
Haden, Sally , "Final OA", U.S. Appl. No 13/925,617; filed Jun. 24, 2013; dated Oct. 25, 2018.
Haden, Sally , "NonFinal Office Action", U.S. Appl. No. 13/925,617; filed Jun. 24, 2013; dated May 21, 2018.
Haden, Sally , "Notice of Allowance", U.S. Appl. No. 13/925,532; filed Jun. 24, 2013; dated Jan. 11, 2019.
Haden, Sally , "Notice of Allowance", U.S. Appl. No. 13/925,617; filed Jun. 24, 2013; dated Sep. 12, 2017.
Haden, Sally C. , "Final OA", U.S. Appl. No. 13/804,565; filed Mar. 14, 2013; dated May 8, 2017.
Haden, Sally C. , "Final OA", U.S. Appl. No. 14/679,628; filed Apr. 6, 2015; dated Oct. 25, 2018.
Haden, Sally C. , "Final OA", U.S. Appl. No. 14/942,755; filed Nov. 16, 2015; dated Mar. 27, 2018.
Haden, Sally C. , "NonFinal OA", U.S. Appl. No. 14/679,628; filed Apr. 6, 2015; dated Sep. 5, 2017.
Haden, Sally Cline , "NonFinal OA", U.S. Appl. No. 13/804,565; filed Mar. 14, 2013; dated Jan. 19, 2017.
Haden, Sally Cline , "NonFinal OA", U.S. Appl. No. 13/925,532; filed Jun. 24, 2013; dated Aug. 9, 2017.
Haden, Sally Cline , "NonFinal OA", U.S. Appl. No. 14/942,755; filed Nov. 16, 2015; dated Sep. 8, 2017.
McVey, Lauren , "Ex Parte Quayle", U.S. Appl. No. 29/467,603; filed Sep. 20, 2013; dated Jul. 26, 2017.
McVey, Lauren , "Final OA", U.S. Appl. No. 29/545,805; filed Nov. 16, 2015; dated May 17, 2018.
McVey, Lauren , "Final OA", U.S. Appl. No. 29/545,806; filed Nov. 16, 2015; dated May 17, 2018.
McVey, Lauren , "Final Office Action", U.S. Appl. 29/467,603; filed Sep. 20, 2013; dated Feb. 8, 2017.
McVey, Lauren , "Final Office Action", U.S. Appl. No. 29/545,802; filed Nov. 16, 2015; dated May 17, 2018.
McVey, Lauren , "NonFinal OA", U.S. Appl. No. 29/545,802; filed Nov. 16, 2015; dated Jun. 1, 2017.
McVey, Lauren , "NonFinal OA", U.S. Appl. No. 29/545,805; filed Nov. 16, 2015; dated Dec. 10, 2018.
McVey, Lauren , "NonFinal OA", U.S. Appl. No. 29/545,805; filed Nov. 16, 2015; dated Jun. 2, 2017.
McVey, Lauren , "NonFinal OA", U.S. Appl. No. 29/545,806; filed Nov. 16, 2015; dated Jun. 1, 2017.
McVey, Lauren , "NonFinal OA", U.S. Appl. No. 29/545,806; filed Nov. 16, 2015; dated Feb. 12, 2019.
McVey, Lauren , "Notice of Allowance", U.S. Appl. No. 29/545,802; filed Nov. 16, 2015; dated Feb. 19, 2019.
Walshon, Rashida , "Final Office Action", U.S. Appl. No. 29/591,354; dated Nov. 13, 2018.
Walshon, Rashida , "NonFinal Oa", U.S. Appl. No. 29/591,354; filed Jan. 19, 2017; dated Oct. 4, 2017.
Walshon, Rashida, "Non-Final OA", U.S. Appl. No. 29/591,354; filed Jan. 19, 2017; dated Apr. 17, 2018.
The visual dictionary. <URL: http://www.infovisual.info/06/049_en.html>. types of cuffs (Examiner provided updated NPL (viewed Apr. 24, 2019) May 16, 2019 from original views Examiner provided in U.S. Appl. No. 29/467,612 dated Jun. 5, 2015).
Bravo, Jocelyn , "NonFinal OA", U.S. Appl. No. 14/086,798; filed Nov. 21, 2013; dated May 20, 2019.
Haden, Sally , "Notice of Allowance", U.S. Appl. No. 14/679,628; filed Apr. 6, 2015; dated Mar. 29, 2019.
Haden, Sally C. , "Notice of Allowance", U.S. Appl. No. 13/804,565; filed Mar. 14, 2013; dated Mar. 28, 2019.
McVey, Lauren , "NonFinal OA", U.S. Appl. No. 29/545,805; filed Nov. 16, 2015; dated May 16, 2019.

* cited by examiner

DISPOSABLE MEDICAL GOWN

BACKGROUND

Technical Field

This invention relates generally to medical gowns, and more particularly to disposable medical gowns.

Background Art

Medical gowns are commonly used in hospitals, clinics and other diagnostic facilities. Medical gowns are worn by both patients and health care providers during medical procedures. Medical gowns serve a protective function by helping to prevent the transmission of germs and microbes. Additionally, gowns worn by the patient provide a privacy function and help to preserve patient dignity by covering the patient's body prior to examination or prior to a medical procedure. For instance, a particular medical examination may require the patient to disrobe. Donning a medical gown serves as a "cover-up" in that it covers the patient's unclad body until the examination or procedure can be performed.

One issue with prior art medical gowns is that they are time-consuming to put on and take off. It would be advantageous to have an improved medical gown that is quicker and simpler to don and remove.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
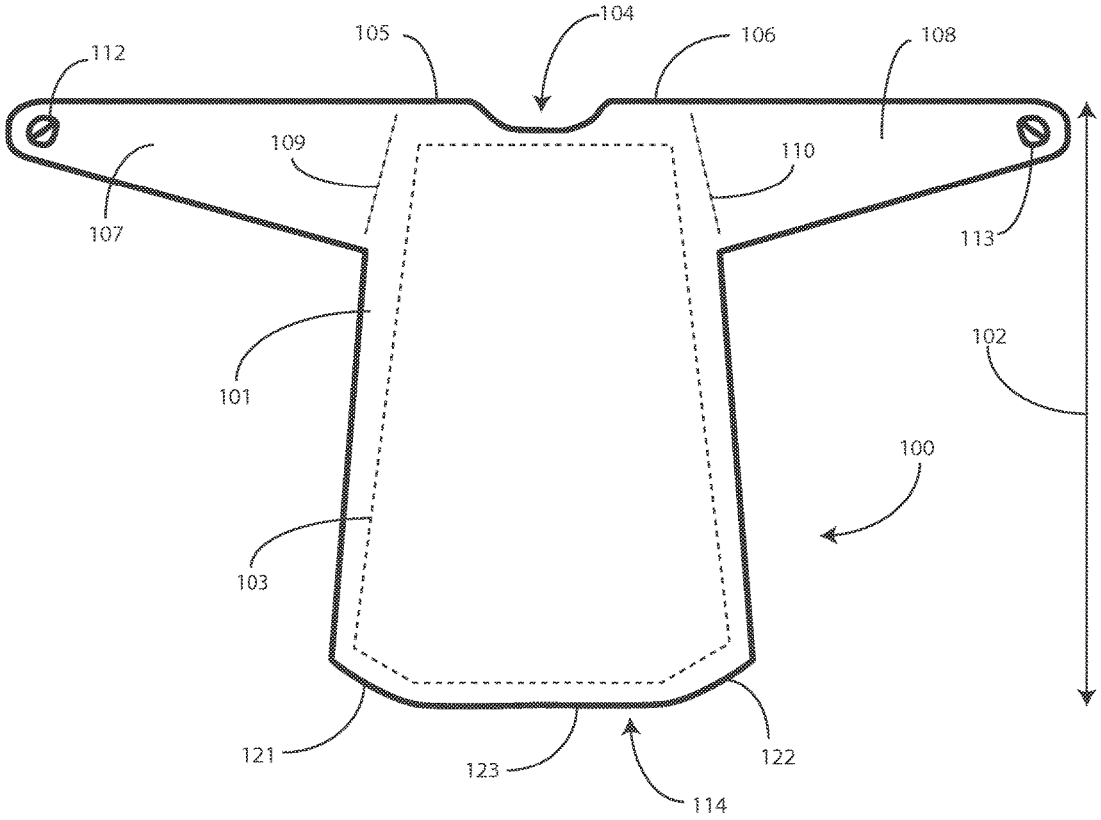
FIG. 1 illustrates a front view of one example of a gown configured in accordance with one or more embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the present invention provide a disposable medical gown capable of being quickly donned by a patient or medical services provider, and are even more quickly removed. In one embodiment, for example, the gown is made from a non-woven material and includes one or more perforations, thereby enabling a user to easily tear the gown at the perforations or other locations when removing the gown.

Figure 2:
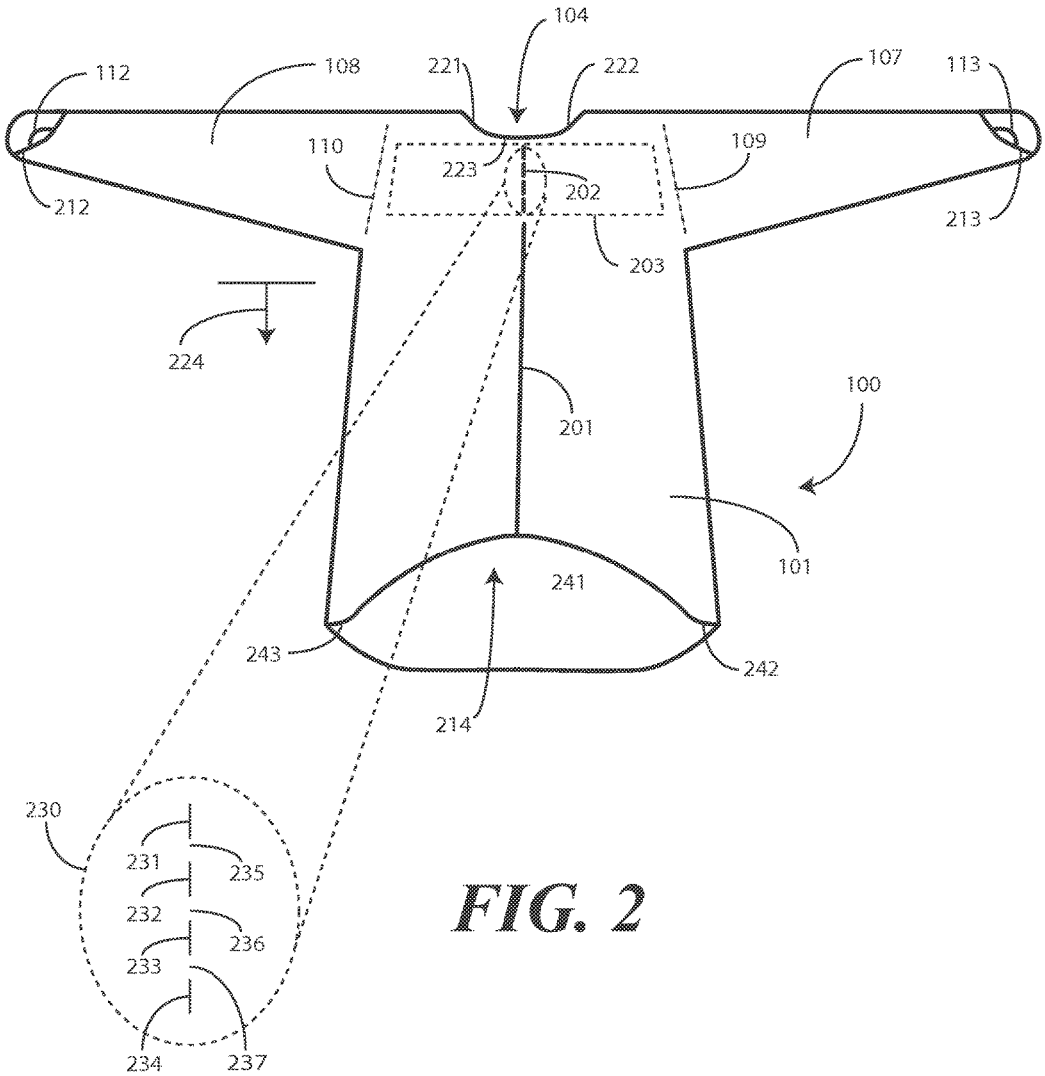
FIG. 2 illustrates a rear view of one example of a gown configured in accordance with one or more embodiments of the invention.

Turning now to FIGS. 1 and 2, illustrated therein is one example of a medical gown 100 configured in accordance with one or more embodiments of the invention. A body covering portion 101 is configured to wrap about the torso of a wearer. The body covering portion 101, in one embodiment, is manufactured from a single, unitary layer of non-woven fabric. The non-woven fabric can be a disposable material, and optionally can include and water resistant lining that prevents the passage of fluids through the body covering portion 101. In one embodiment, the length 102 of the medical gown 100 is configured to run from a wearer's shoulder to below their knee. In one embodiment, the gown 100 may optionally include pockets or other surface features. The gown 100 may be manufactured in various colors. However, experimental testing has shown that yellow is a color particularly well suited for medical procedures due to its high visibility and easy differentiation from a patient's skin.

The body covering portion 101 includes a front portion 103 and a rear portion 203. The front portion 103 is configured as a frontal body covering portion in that it is configured to cover the frontal portion of some or all of a user's body, or in another embodiment the frontal portion of some or all of a user's torso, when the user is wearing the gown. The body covering portion 101 further includes a rear portion 203 that is configured to cover at least a portion of a wearer's shoulder blades. In the illustrative example of FIGS. 1 and 2, the rear portion 203 has a substantially similar length with the front portion 103, although this will not be the case with all embodiments described below. In one embodiment for example, the front portion 103 will be longer than the rear portion 203, thereby covering more of the wearer's body in the front than the rear. In another embodiment, the front portion 103 will be shorter than the rear portion 203, thereby covering less of the wearer's body in the front than in the rear.

In one embodiment, the body covering portion 101 defines a head insertion aperture 104 through which a user may insert their head when donning the gown. In the illustrative embodiment of FIGS. 1 and 2, the head insertion aperture 104 is disposed between the front portion 103 and the rear portion 203, and is surrounded by shoulder portions 105,106 of the body covering portion 101. The perimeter of the head insertion aperture 104 can take a variety of shapes. For example, in the illustrative embodiment of FIGS. 1 and 2, the head insertion aperture 104 has an angle-tapered flat contour, with two angular side edges 221,222 radially interfacing with a substantially flat contour 223. Other embodiments described below may include different heat insertion aperture contours.

In one embodiment, the body covering portion 101 defines an opening 201. The front portion 103 of the gown 100 is configured, in one embodiment, to be placed against the front of the torso of a wearer. The body covering portion 101 then wraps around and terminates at the opening 201. The opening 201 in this embodiment has a left side and a right side, and is configured as a slit that runs most of the length 102 of the body covering portion 101, up the back of the medical gown 100.

The opening can be used to assist in donning the gown. For instance, a user may open the opening 201 and pass their head, shoulders, and/or torso portions through the opening 201 when donning the gown. Said differently, the right side and left side of the opening 201 can be configured to permit the wearer to don the gown 100 by wrapping the right side and left side 107 about the wearer's torso. In the illustrative embodiment of FIGS. 1 and 2, the opening 201 is disposed on a side 224 of the rear portion 203 opposite the head insertion aperture 104. The opening 201 then extends distally from the rear portion 203 to a base of the body covering portion 101.

In one embodiment, the gown 100 includes one or more perforations 202. In FIGS. 1 and 2, a single perforation 202 extends across the rear portion 203, at least partially between the opening 201 and the head insertion aperture 104. The perforation 202 can assist the user in removing the gown 100 by providing a score line that can be easily torn. Said differently, in one embodiment the perforation 202 is configured to tear when the front portion 103 is pulled away from the wearer. This will be shown in more detail in subsequent figures. When this occurs, the tearing of the perforation 202 results in a splitting of the rear portion 203. The splitting or tearing can cause the body covering portion 101 to separate between the head insertion aperture 104 and the opening 201, thus extending the opening 201 all the way to the head insertion aperture 104. A user can therefore easily remove the gown 100 by simply tearing the perforation 202 and pulling the gown 100 off.

In one embodiment, the perforation 202 comprises a plurality of scores 231,232,233,234, as shown in the magnified perforation view 230. Each of the scores 231,232,233,234 is separated by a corresponding length 235,236,237 of material. While the configuration of the perforations 202 can take a variety of configurations, experimental testing has shown that some configurations are more suited to easy removal of the gown 100 than others. Additionally, some configurations are easier to manufacture than are others. One such example of a perforation 202 is where the plurality of scores 231,232,233,234 are each about one inch long. (The term "about is used to describe a quantity inclusive of manufacturing and other tolerances. For example, in a score designed to be one inch in length, manufacturing and other tolerances may result in the score being, for example, 1.02" or 0.972", each if which is "about" one inch as the term is used herein.) In one exemplary embodiment, the lengths 235,236,237 of material are each about one half inch long. In one exemplary embodiment, four scores are used to make the perforation 202.

Another example is a perforation 202 in which the plurality of scores, e.g., scores 231,232,233,234 et al., are each about three-quarters of an inch long. In this embodiment, the lengths of material, e.g., lengths 235,236,237 et al., are each about one quarter inch long. In one exemplary embodiment, nine scores are used to make perforation 202.

In one embodiment, to further assist the user in removing the gown, the non-woven fabric is configured so as to be tearable by a wearer. For example, to non-woven fabric may have a tensile strength of between four and ten pounds. Thus, if a user were to grasp opposing sides of a section of the non-woven fabric, and then pull with a force of between four and ten pounds, the fabric would tear. As will be shown below, and one embodiment all where removes the gown by tearing the non-woven fabric. Accordingly, a non-woven fabric that is easily tearable by a wide range of wearers, e.g., male and female wearers, may be selected for construction of the medical gown 100 in accordance with such an embodiment.

In one embodiment, a first sleeve 107 and a second sleeve 108 extend distally from the body covering portion 101. The first sleeve 107 and the second sleeve 108 are configured to receive wearer's arms when the medical down 100 is donned. In one embodiment, each of the first sleeve 107 and the second sleeve 108 are configured as single, unitary pieces of non-woven fabric that are attached with the body covering portion 101 at a seams 109,110. The seams 109,110 can be sewn, although other attachment processes can be used as well. Examples of alternative attachment processes include adhesive bonding, mechanical or press-fit bonding, thermal bonding, and so forth. In the illustrated embodiment of FIGS. 1 and 2, the first sleeve 107 and second sleeve 108 are illustrated as long sleeves. However, it will be clear to those of ordinary skill in the art having the benefit of disclosure that embodiments of the invention are not so limited. Medical gowns in accordance with embodiments of the invention may equally be configured with short sleeves or no sleeves has a particular application may warrant.

In one or more embodiments, the sleeves 107,108 each terminate in a thumb loop. In one embodiment, the thumb loop comprises a thumb insertion aperture 112,113, through which a wearer's thumb may be inserted. In one embodiment, the thumb loop further comprises a hand saddle curvature termination 212,213. In this embodiment, the hand saddle curvature terminations 212,213 back the thumb insertion apertures and can be seen therethrough when the sleeves 107,108 are pressed flat. The backing of the thumb insertion apertures 112,113 by hand saddle curvature terminations 212,213 that work to permit the heel of a wearer's hand to be exposed when the thumb is inserted into the thumb insertion aperture 112,113. The thumb loops, where included, provide several functions. One illustrative function is that they keep the sleeves 107,108 pulled along the wearer's arms and prevent the sleeves 107,108 from "riding up." Another illustrative function is that the thumb loops prevent twisting of the sleeves 107,108 about the wearer's arm. Each thumb loop is configured, in one embodiment, to engage the saddle of a thumb of the wearer.

The bottom of the gown 100 can take a variety of shapes. For example, in the illustrative embodiment of FIGS. 1 and 2, the front base member 114 of the gown 100 substantially mirrors the shape of the perimeter of the head insertion aperture 104. In this case, the front base member 114 has an angle-tapered flat contour, with two angular side edges 121,122 radially interfacing with a substantially flat contour 123. Other embodiments described below may include different front contours. In this illustrative embodiment, the rear contour 214 takes a concave down contour, with an arched contour 241 spanning between two convex lobes 242,243.

Figure 3:
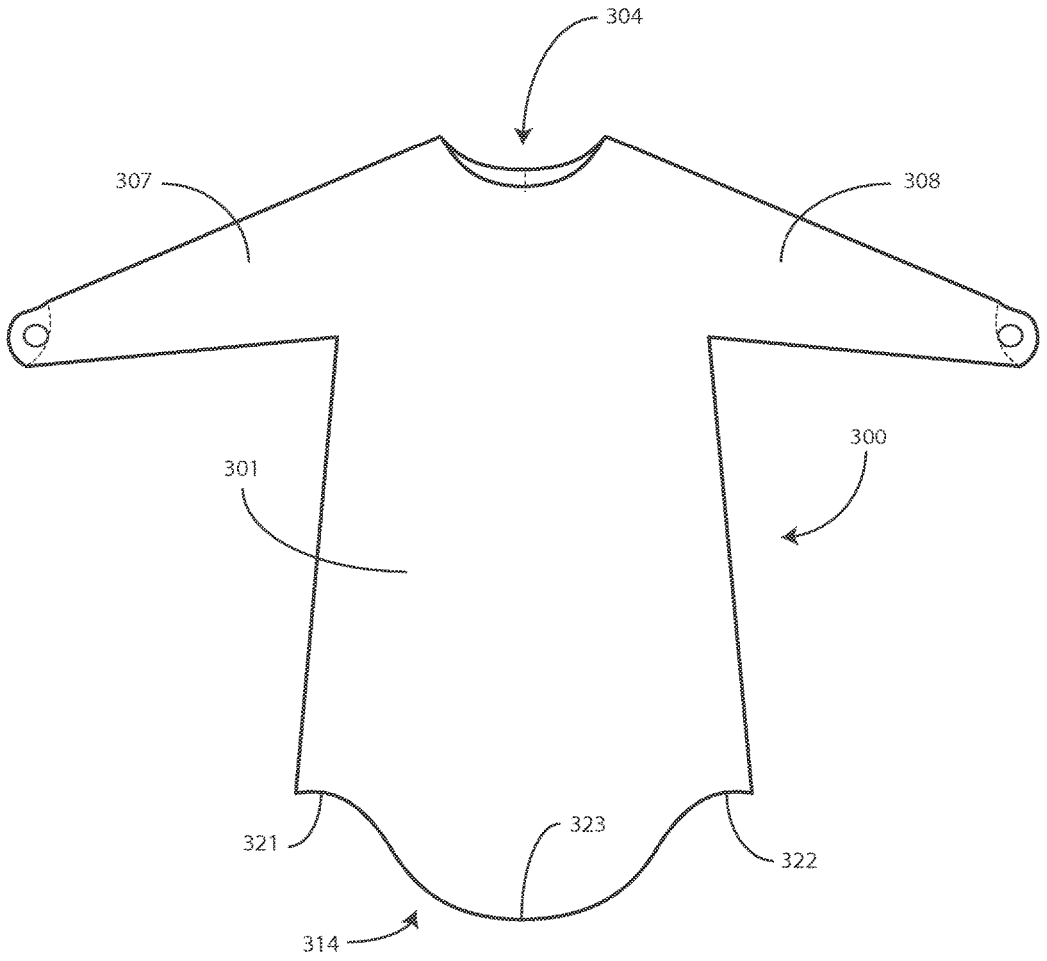
FIG. 3 illustrates a front view of another example of a gown configured in accordance with one or more embodiments of the invention.
Figure 4:
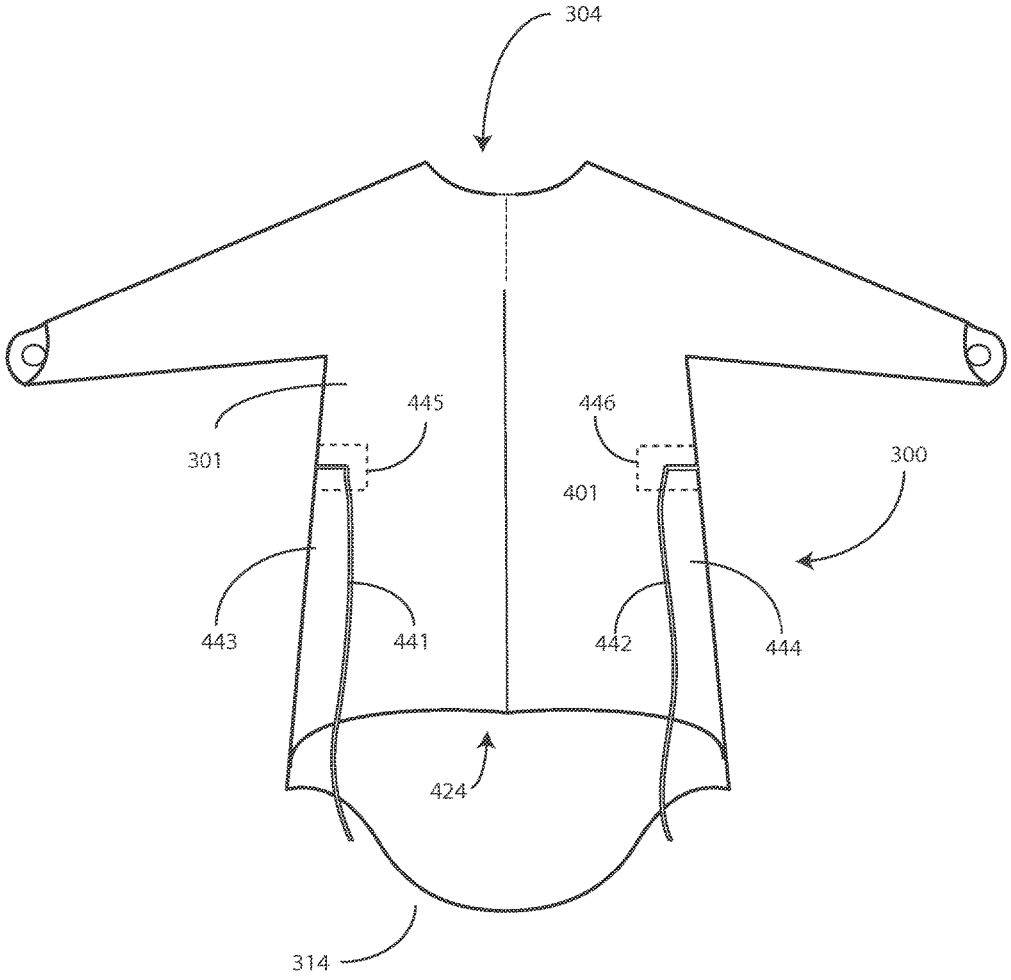
FIG. 4 illustrates a rear view of another example of a gown configured in accordance with one or more embodiments of the invention.
Figure 5:
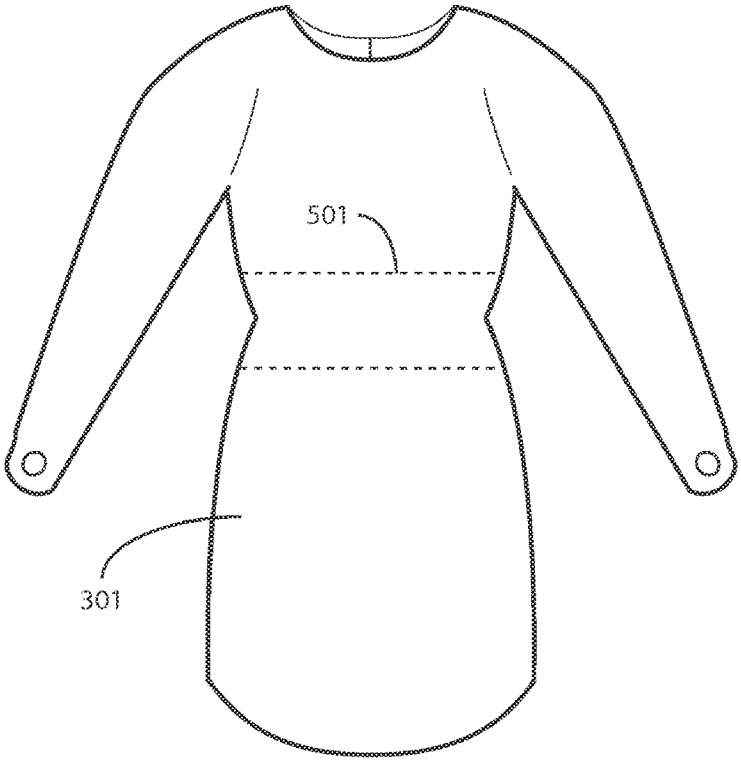
FIG. 5 illustrates a front view of another example of a gown configured in accordance with one or more embodiments of the invention having tie members tied.
Figure 6:
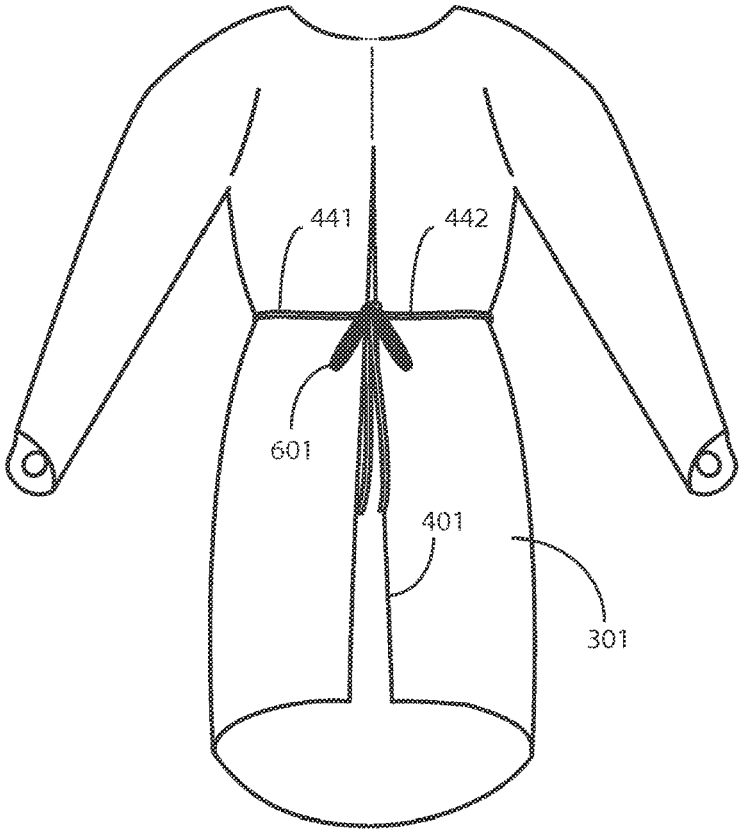
FIG. 6 illustrated a rear view of another example of a gown configured in accordance with one or more embodiments of the invention having tie members tied.
Figure 7:
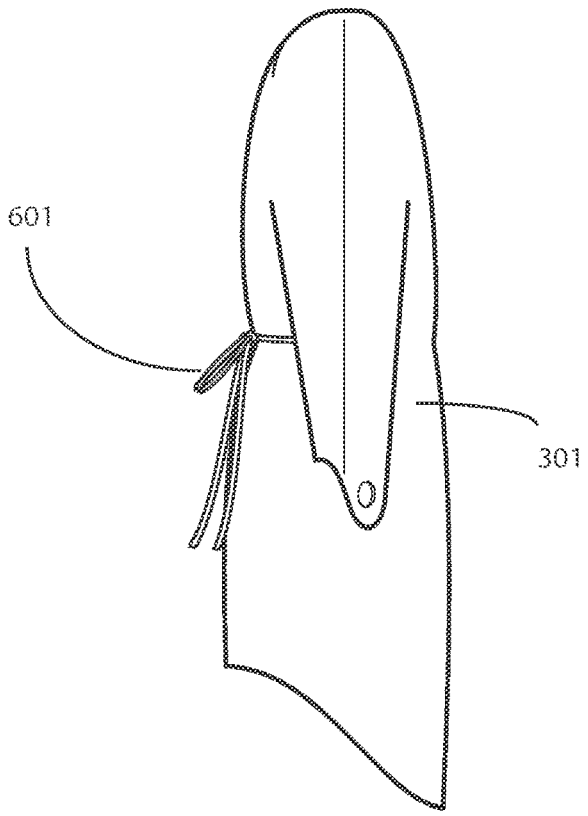
FIG. 7 illustrates a side view of another example of a gown configured in accordance with one or more embodiments of the invention having tie members tied.
Figure 8:
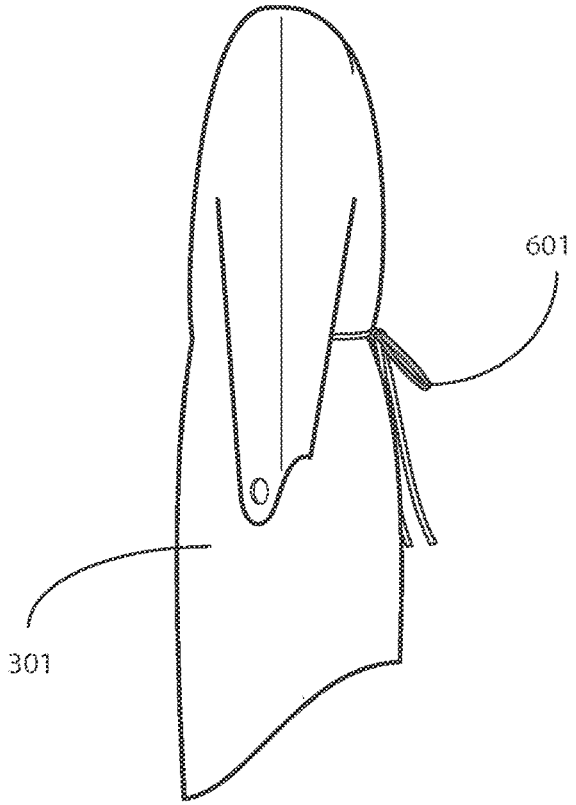
FIG. 8 illustrates another side view of another example of a gown configured in accordance with one or more embodiments of the invention having tie members tied.

Turning now to FIGS. 3 and 4, illustrated therein is another medical gown 300 configured in accordance with one or more embodiments of the invention. The elements that medical gown 300 shares with the gown (100) of FIGS. 1 and 2, including sleeves, body covering portion, front portion, rear portion, perforation, opening, and thumb loops, will not be repeated in the description of medical gown 300 for brevity.

The contour of the head insertion aperture 304 is different from that shown in FIGS. 1 and 2. In FIGS. 3 and 4, the head insertion aperture 304 is curved in a partially circular shape. Additionally, the front base member 114 is different from that shown in FIGS. 1 and 2. In the illustrative embodiment of FIGS. 3 and 4, the front base member 314 is concave-convex, with a major, central convex curvature 323 centrally spanning two minor concave curvatures 321,322. The concave-convex design permits a wearer to move their knees or legs vertically with the major, central convex curvature 323 providing privacy across the wearer's lower pelvic region.

Another difference is the rear base member 424. In this illustrative embodiment, the rear base member 424 is a simple concave down curvature, omitting the convex lobes (242,243) found in FIG. 2.

Another difference is with respect to the sleeves 307,308. While the sleeves (107,108) of FIGS. 1 and 2 were outstretched, with upwardly tapering base members, the sleeves 307,308 of FIGS. 3 and 4 are downwardly tapering, with downwardly tapering upper arm members.

One of the primary differences between the gown (300) of FIGS. 3 and 4 and the gown (100) of FIGS. 1 and 2 is the inclusion of one or more tie members 441,442 extending from the body covering portion 301. In this illustrative embodiment, the tie members include a first tie member 441 disposed on a first side 442 of the body covering portion 301, and a second tie member 442 disposed on a second side 444 of the body covering portion 301. Accordingly, one tie member 441 is disposed on one side of the opening 401, while the second tie member 442 is disposed on a second side of the opening 401.

The tie members 441,442 can be attached to the body covering portion 301 in a variety of ways. In one embodiment, the tie members 441,442 are sewn to the body covering portion 301. In another embodiment, the tie members 441,442 are adhesively attached to the body covering portion 301. In another embodiment, the tie members 441, 442 are thermally bonded to the body covering portion 301. Other attachment methods will be obvious to those of ordinary skill in the art.

In the illustrative embodiment of FIGS. 3 and 4, the tie members 441,442 are attached at hip regions 445,446 of the gown 300. Turning to FIGS. 5-8, when the tie members 441,442 are tied 601 across the opening 401, the body covering portion 301 become "cinched" at the waist region 501 about the wearer.

Figure 9:
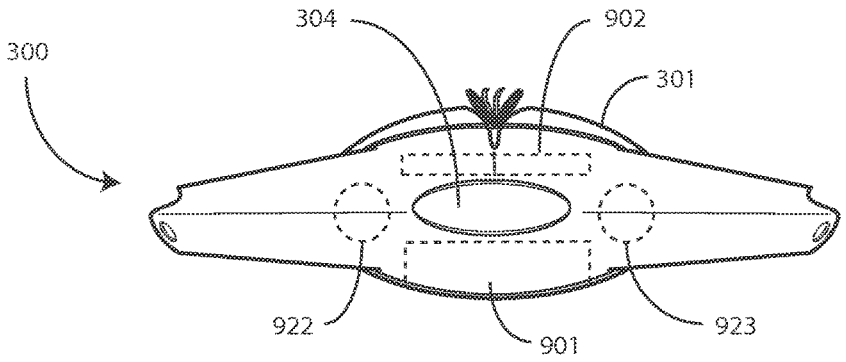
FIG. 9 illustrates a top view of another example of a gown configured in accordance with one or more embodiments of the invention having tie members tied.
Figure 10:
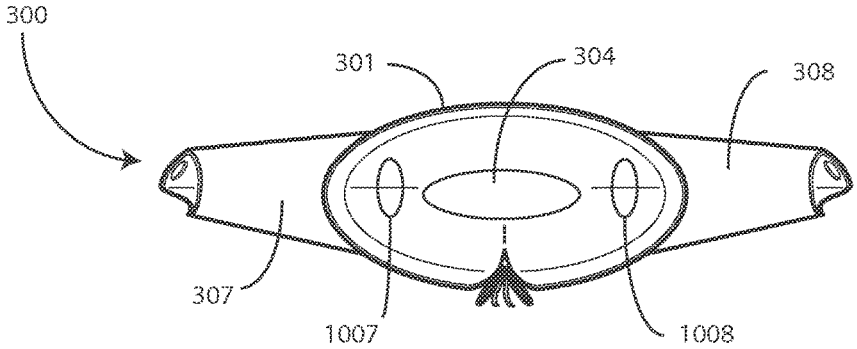
FIG. 10 illustrates a bottom view of another example of a gown configured in accordance with one or more embodiments of the invention having tie members tied.

Turning to FIGS. 9 and 10, additional features of the gown 300 can be seen. FIG. 9 provides a top plan view of the gown 300. From this view, it can be seen that the head insertion aperture 304 is disposed along the body covering portion 301 between the front portion 901 and rear portion 902. Also, the head insertion aperture 304 is disposed between shoulder portions 922,923. From the bottom plan view of FIG. 10, it can be seen that the sleeves 307,308, which extend distally away from the body covering portion 301, each defining an arm insertion aperture 1007,1008 at an interface with the body covering portion 301.

Figure 11:
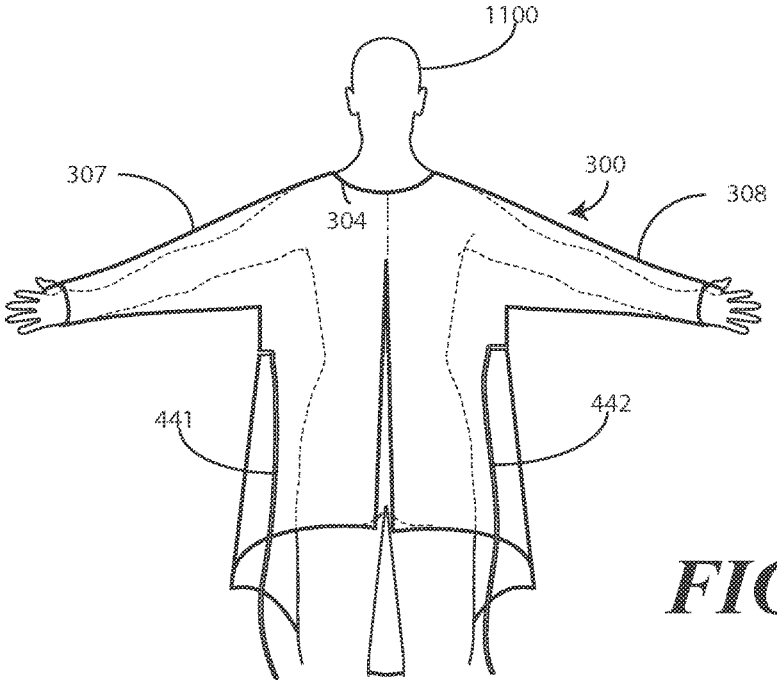
FIG. 11 illustrates a rear view of a user wearing another example of a gown configured in accordance with one or more embodiments of the invention prior to tying the tie members.
Figure 12:
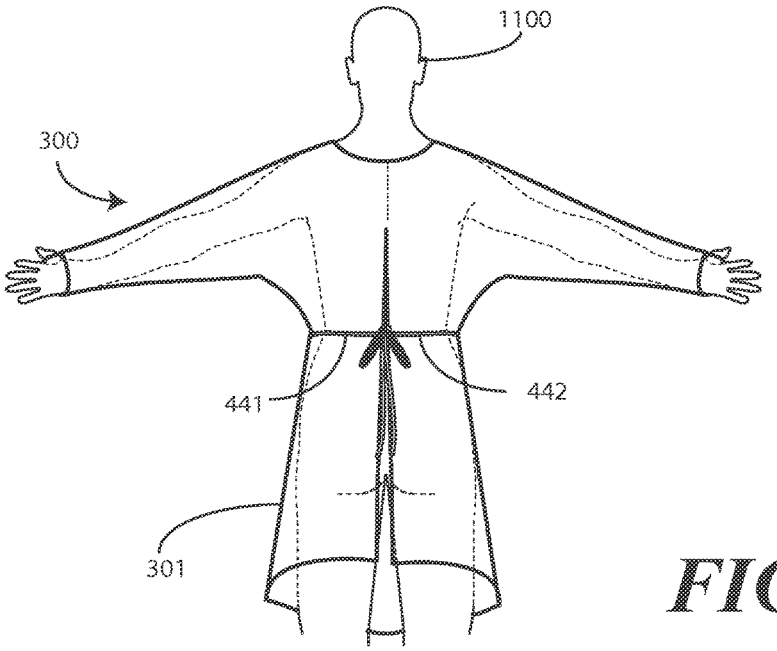
FIG. 12 illustrates a rear view of the user wearing another example of a gown configured in accordance with one or more embodiments of the invention after tying the tie members.

Turning now to FIGS. 11 and 12, a wearer 1100 can be seen donning the gown 300. Specifically, the wearer 1100 has inserted his head into the head insertion aperture 304. Also, the wearer has inserted his arms into the arm insertion apertures (1007,1008). The wearer has inserted his thumbs into the thumb loops, thereby retaining the sleeves 307,308 snugly along each arm. The ties 441,442 are initially untied as shown in FIG. 11. Once tied, the ties 441,442 cinch the body covering portion 301 at the user's waist, as shown in FIG. 12.

Figure 13:
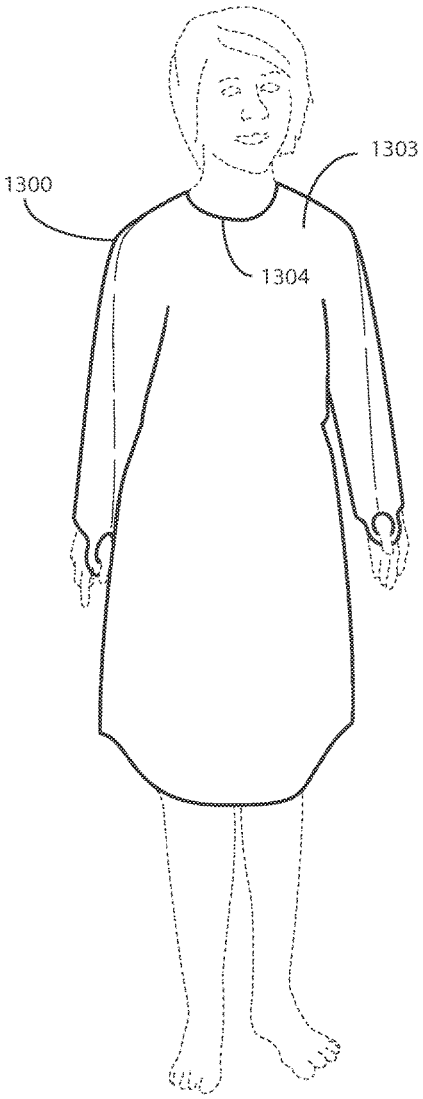
FIG. 13 illustrates another front view of a user wearing another example of a gown configured in accordance with one or more embodiments of the invention having tie members tied.
Figure 14:
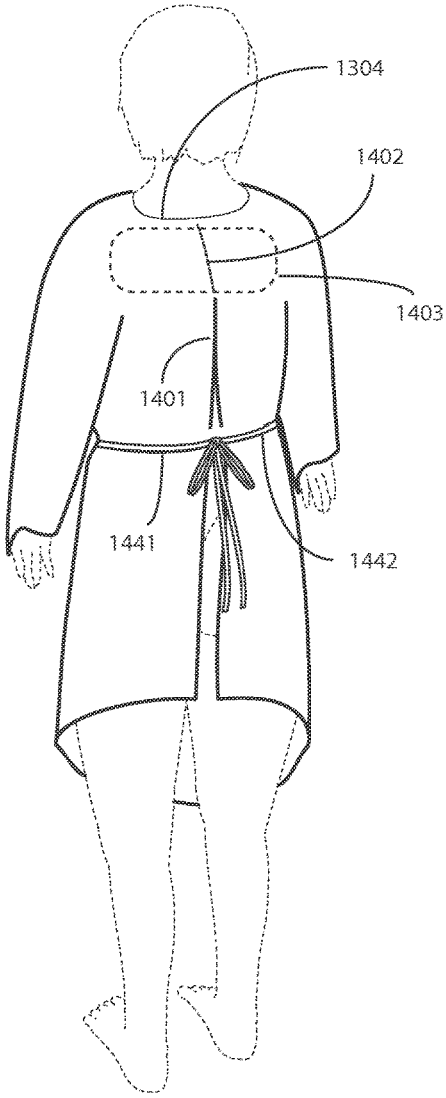
FIG. 14 illustrates another rear view of the user wearing another example of a gown configured in accordance with one or more embodiments of the invention having tie members tied.
Figure 15:
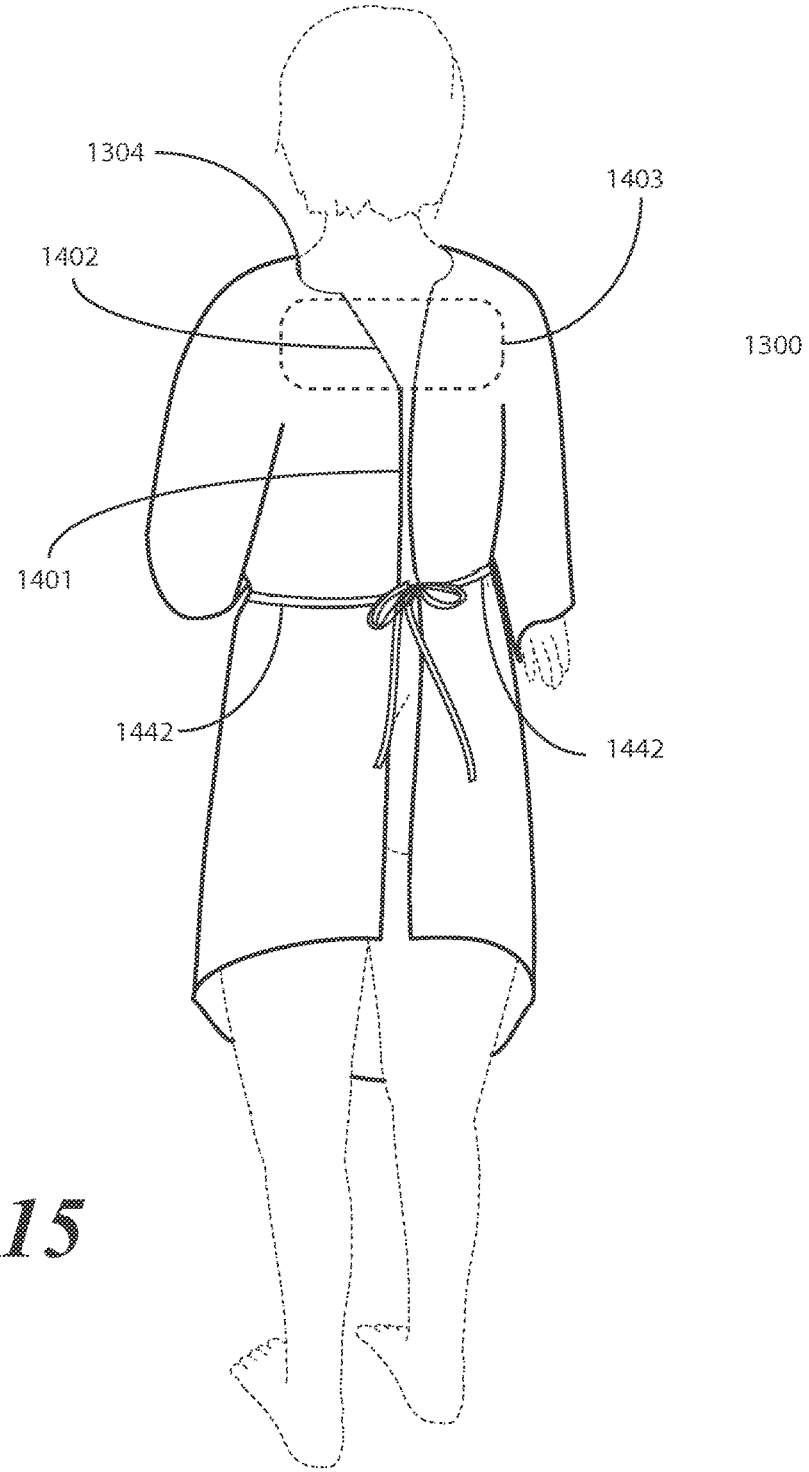
FIG. 15 illustrates a rear view of the user pulling on a front portion of another gown configured in accordance with one or more embodiments of the invention, thereby tearing a perforation to separate a rear portion of the gown.

Turning now to FIGS. 13-15, illustrated therein is a method of wearing and removing a gown 1300 in accordance with one or more embodiments of the invention. As shown in FIGS. 13 and 14, a user has accessed and donned the gown 1300. In this illustrative embodiment, the gown 1300 is manufactured from a non-woven fabric layer defining a neck opening 1304 between a front portion 1303 and a rear portion 1403. The rear portion 1403 includes a torso opening 1401 and a perforation 1402 extending across the rear portion 1403 at least partially between the torso opening 1401 and the neck opening 1304. The gown 1301 also includes one or more tie members 1441,1442 extending from the non-woven fabric layer. As shown in FIGS. 13 and 14, the user has passed her head through the neck opening 1304 and has tied the tie members 1441,1442 about her torso.

Turning now to FIG. 15, the user is now removing the gown 1300. Specifically, in this example she is using her left hand to grasp the front portion 1303 of the gown 1300. She then pulls it away from her torso. This causes the perforation 1402 to tear, thereby splitting the rear portion 1403 of the gown 1300. Where the gown 1300 is manufactured from non-woven material, this pulling action tears the perforation 1402 and splits the non-woven fabric layer between the neck opening 1304 and the torso opening 1401. The user can now simply drop the gown 1300 about her torso and step out of it. Where the tie members 1441,1442 are loosely tied, the pulling action can cause them to become untied, thereby facilitating simple removal of the gown 1300 with a simple stroke.

Figure 16:
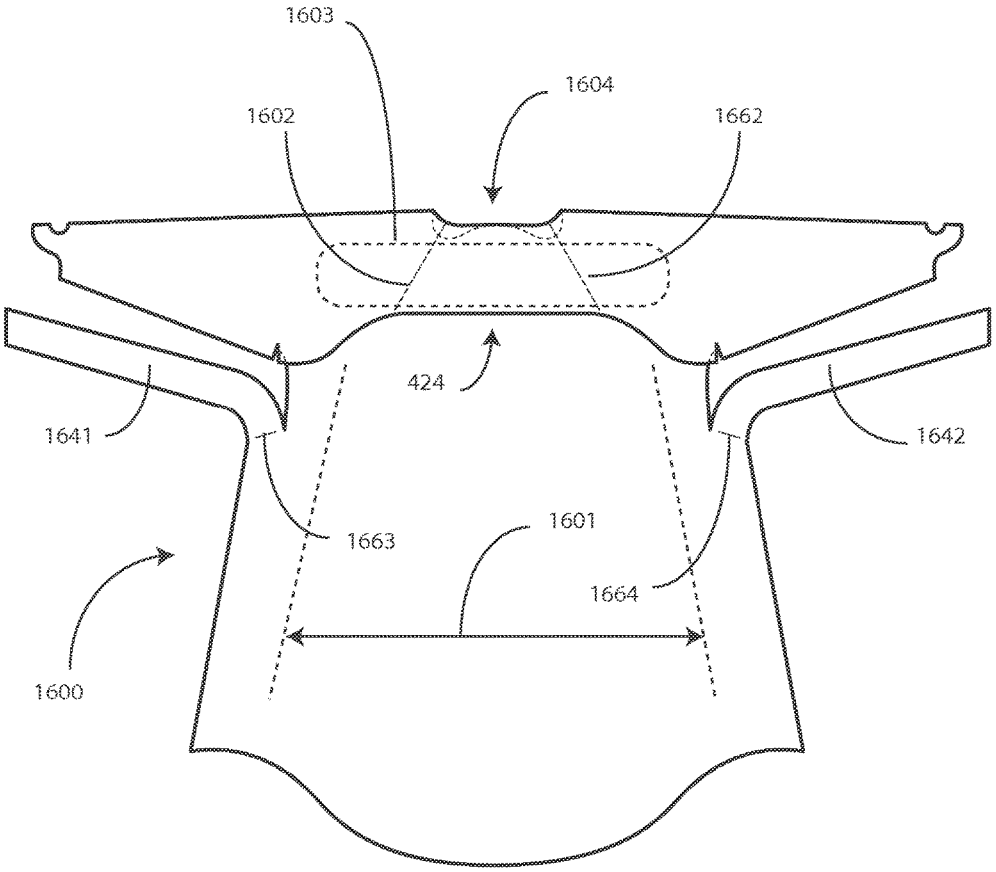
FIG. 16 illustrates a rear view of another example of a gown configured in accordance with one or more embodiments of the invention.
Figure 17:
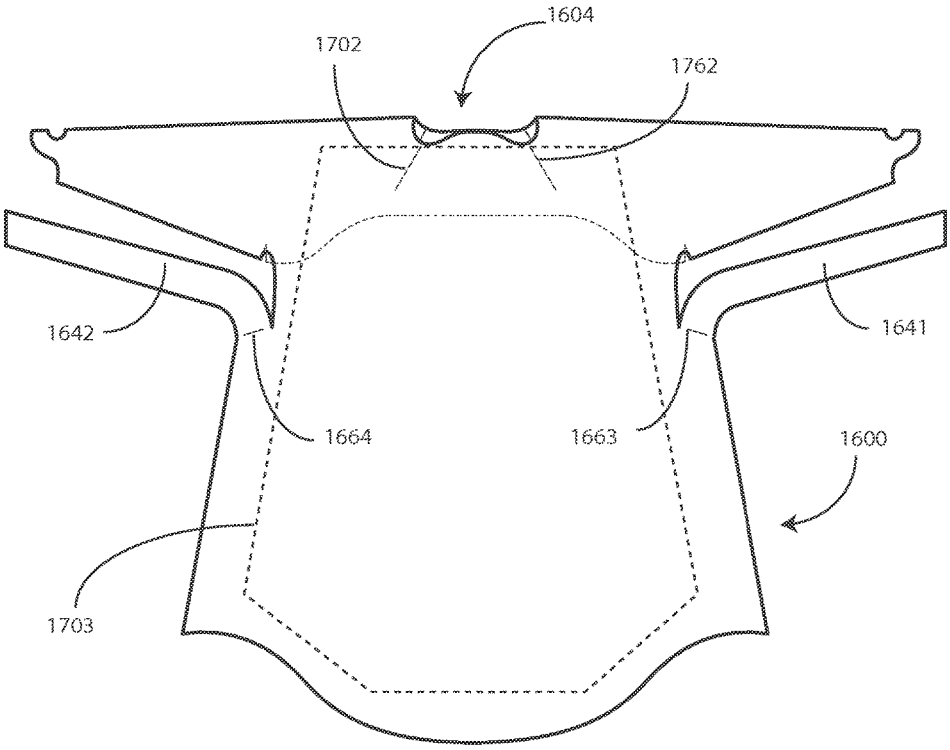
FIG. 17 illustrates a front view of another example of a gown configured in accordance with one or more embodiments of the invention.
Figure 18:
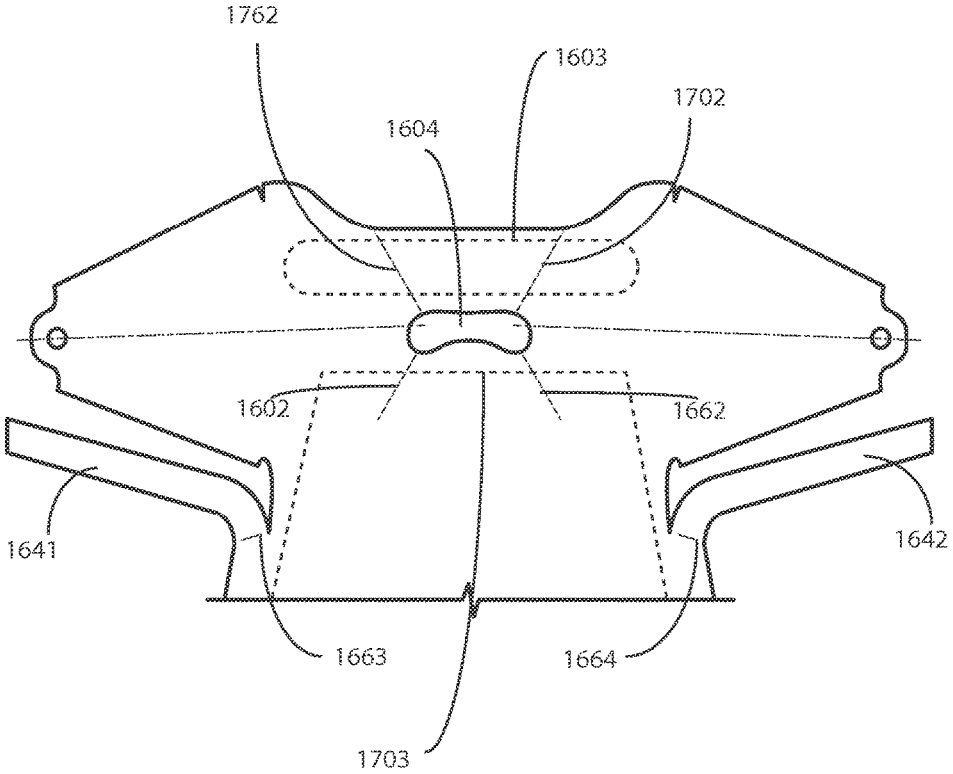
FIG. 18 shows a partial top view of another example of a gown configured in accordance with one or more embodiments of the invention.

Turning now to FIGS. 16-18, illustrated therein is another gown 1600 configured in accordance with one or more embodiments of the invention. FIG. 16 illustrates a rear view of the gown 1600, while FIG. 17 illustrates a front view of the gown 1600. FIG. 18 illustrates a top, plan view of a section of the gown 1600. As with the gown (300) of FIG. 3, the elements that medical gown 1600 shares with the gown (100) of FIGS. 1 and 2 will not be repeated in the description of medical gown 300 for brevity.

Figure 30:
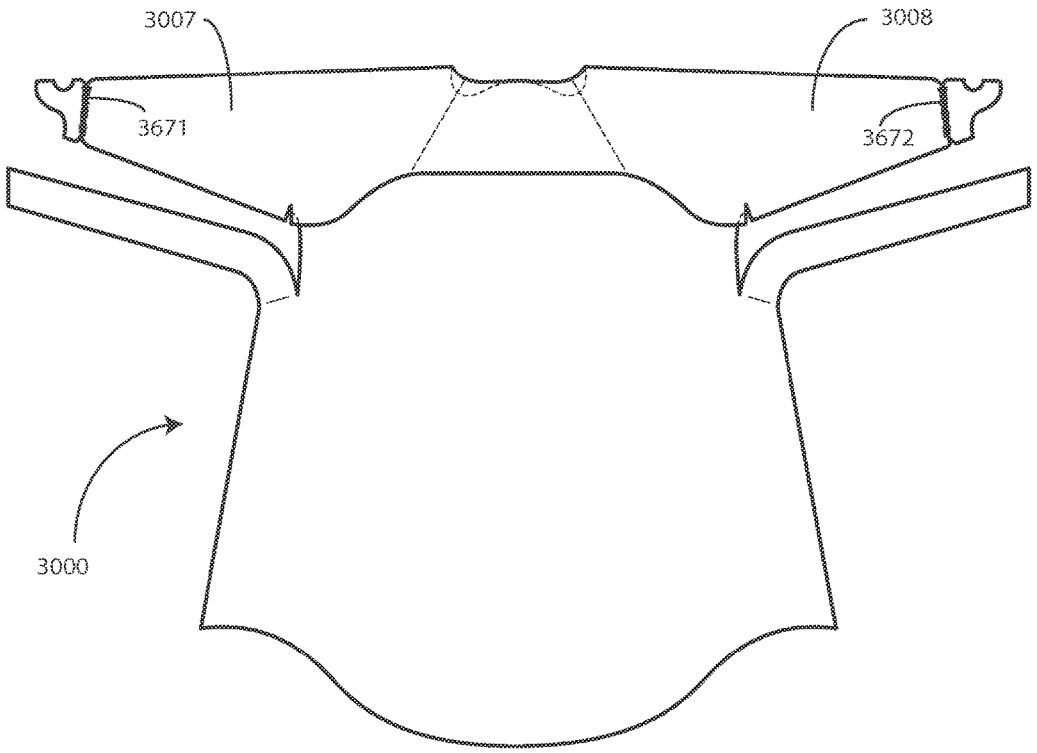
FIG. 30 illustrates a front view another example of a gown configured in accordance with one or more embodiments of the invention.

A first difference in the gown 1600 of FIGS. 16-18 is that the rear portion 1603 is substantially shorter than the front portion 1703. In this embodiment, the rear portion 1603 is configured to cover only portions of the shoulder blades of a wearer, and leave the remaining rear portions of the wearer's torso exposed. Accordingly, the opening 1601 is non-closable and arranged so as to leave exposed at least a six-inch width of a backside of the wearer when the first tie member 1641 and the second tie member 1642 are tied together about a torso of the wearer, as shown in FIG. 30. Such a configuration is suitable, for example, for proctology exams and other similar procedures.

Another difference is the contour of the head insertion aperture 1604. The rear side of the head insertion aperture 1604 has an angle-tapered flat contour, similar to that of FIG. 1. The front side of the head insertion aperture 1604 is concave-convex, with a major, central convex curvature centrally spanning two minor concave curvatures. The rear base member 424 is reverse angle-tapered flat, with two angular portions radially coming to a central member that is substantially flat.

Another difference in the gown 1600 of FIGS. 16-18 is that it includes a plurality of perforations 1602,1662,1702, 1762. Instead of having a single perforation, the gown 1600 includes two perforations 1602,1662 disposed along the rear portion 1603, and two perforations 1702,1762 disposed along the front portion. In the rear portion 1603, the perforations 1602,1662 are arranged so as to extend along the rear portion 1603 so as to diagonally cross at least parts of shoulder blades of the wearer. In the front portion 1703, the perforations 1702,1762 extend across the front portion 1703 diagonally between the head insertion aperture 1604 and the sleeves or the arm insertion apertures.

Yet another difference in the gown 1600 from previous embodiments is that the tie members 1641,1642 are integral with the body covering portion 1701. Said differently, the same material from which the body covering portion 1701 is made is used to make the tie members 1641,1642, as the tie members 1641,1642 are simply extensions of that material. Additionally, in the illustrative embodiment of FIGS. 16-18, the tie members 1641,1642 are "tearable" due to a score line

1663,1664 extending across a width portion of the tie members at an interface of the tie members 1641,1642 with the body covering portion 1703. In one embodiment, the score lines 1663,1664 are non-linear and measure between one and three inches in length.

Figure 19:
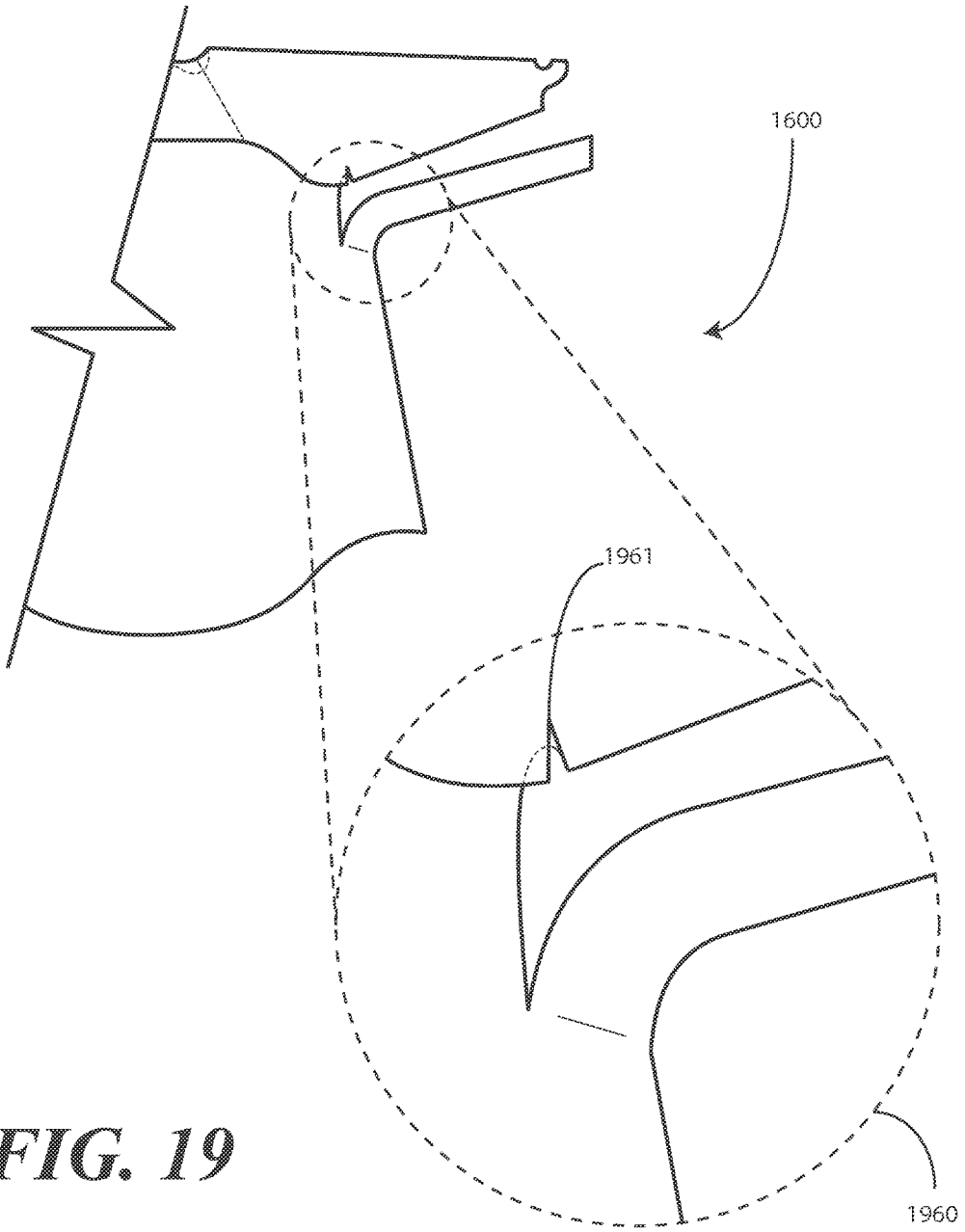
FIG. 19 shows a close-up, rear underarm portion of a gown configured in accordance with one or more embodiments of the invention.
Figure 20:
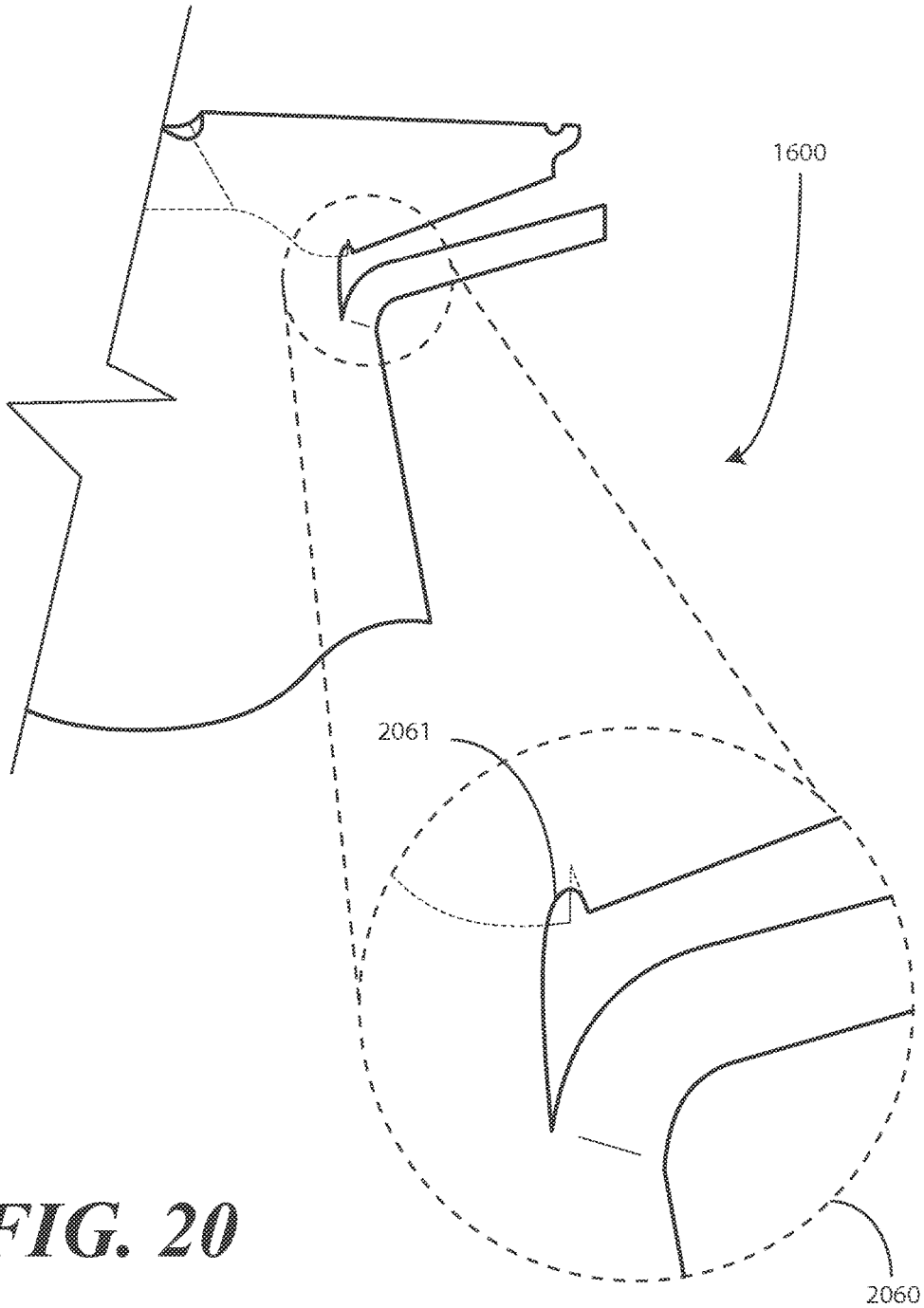
FIG. 20 illustrates a close-up, front underarm portion of a gown configured in accordance with one or more embodiments of the invention.

Turning now to FIGS. 19 and 20, illustrated therein is another difference between the gown 1600 and previous embodiments. FIG. 19 shows a rear view of the gown 1600, with a rear underarm area 1960 shown in an expanded view. FIG. 20 shows a front view of the gown, with a front underarm area 2060 shown in an expanded view.

The gown includes a loop-check configuration with the rear underarm area 1960 including a check indention 1961. The front underarm area 2060 has a corresponding loop 2061 co-aligned with the check indention 1961 so that the two at least partially overlap when the gown 1900 is pressed flat.

Figure 21:
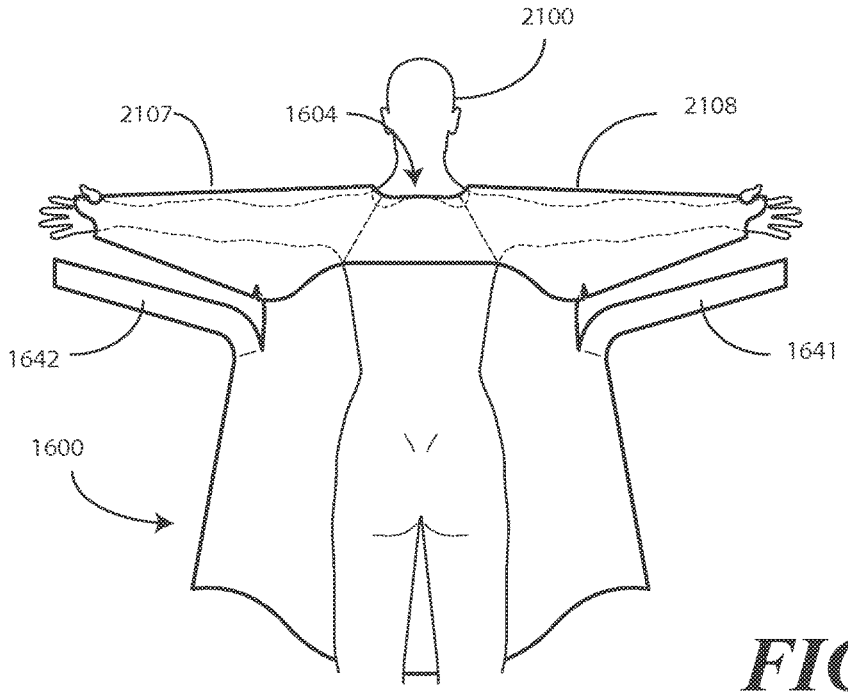
FIG. 21 illustrates a rear view of a user wearing another example of a gown configured in accordance with one or more embodiments of the invention prior to tying the tie members.
Figure 22:
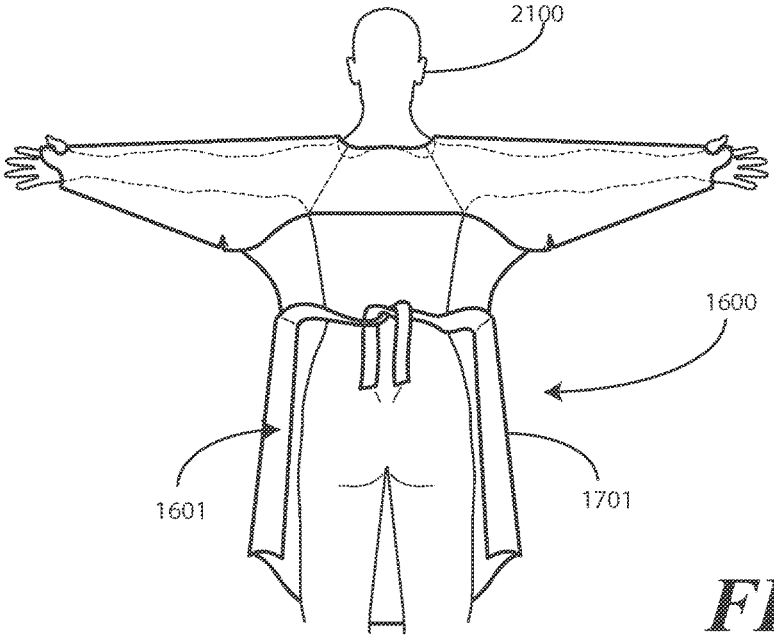
FIG. 22 illustrates a rear view of the user wearing another example of a gown configured in accordance with one or more embodiments of the invention after tying the tie members.

Turning now to FIGS. 21 and 22, a wearer 2100 can be seen donning the gown 1600. Specifically, the wearer 2100 has inserted his head into the head insertion aperture 1604. Also, the wearer has inserted his arms into the arm insertion apertures. The wearer has inserted his thumbs into the thumb loops, thereby retaining the sleeves 2107,2108 snugly along each arm. The tie members 1641,1642 are initially untied as shown in FIG. 21. Once tied, the tie members 1641,1642 cinch the body covering portion 1701 about the torso, as shown in FIG. 22. However, due to the non-closable opening 1601 at least a six-inch width of the wearer's backside s exposed when the first tie member 1641 and the second tie member 1642 are tied together about a torso of the wearer 2100.

Figure 23:
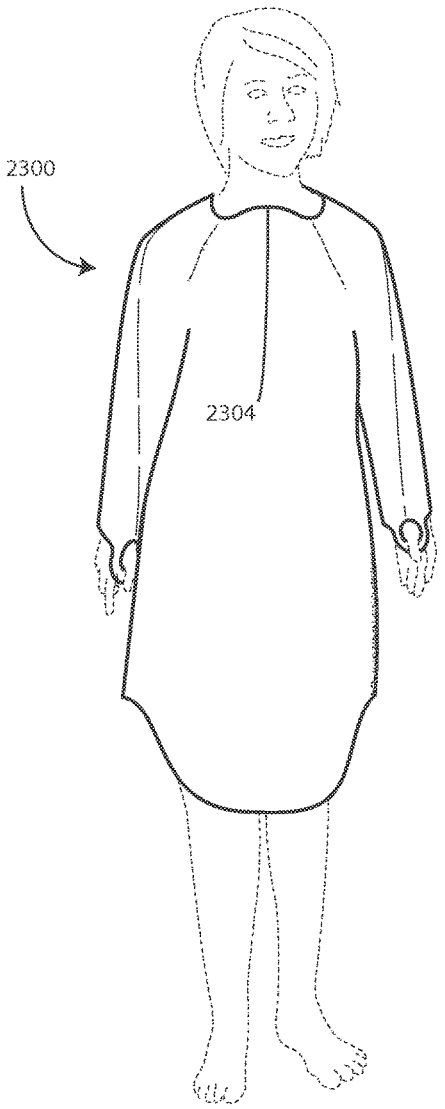
FIG. 23 illustrates another front view of a user wearing another example of a gown configured in accordance with one or more embodiments of the invention having tie members tied.
Figure 24:
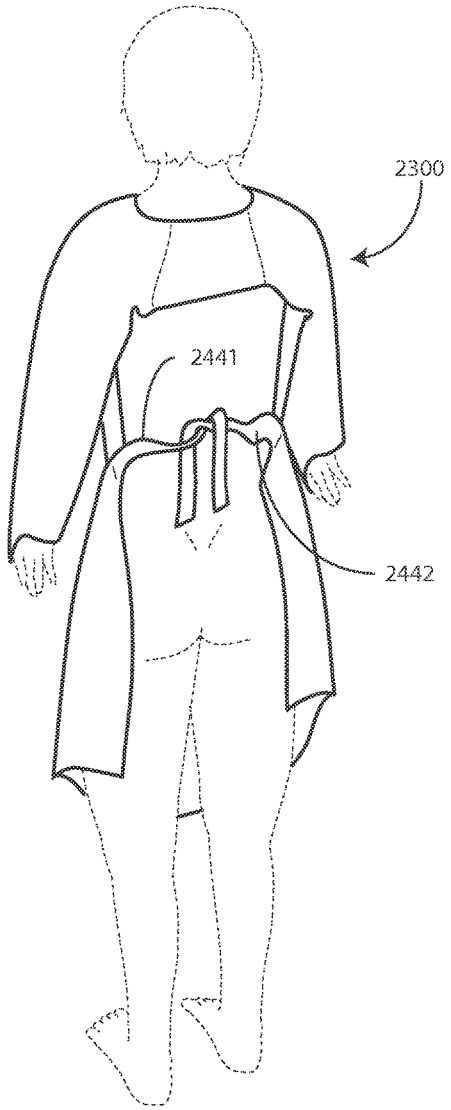
FIG. 24 illustrates another rear view of the user wearing another example of a gown configured in accordance with one or more embodiments of the invention having tie members tied.
Figure 25:
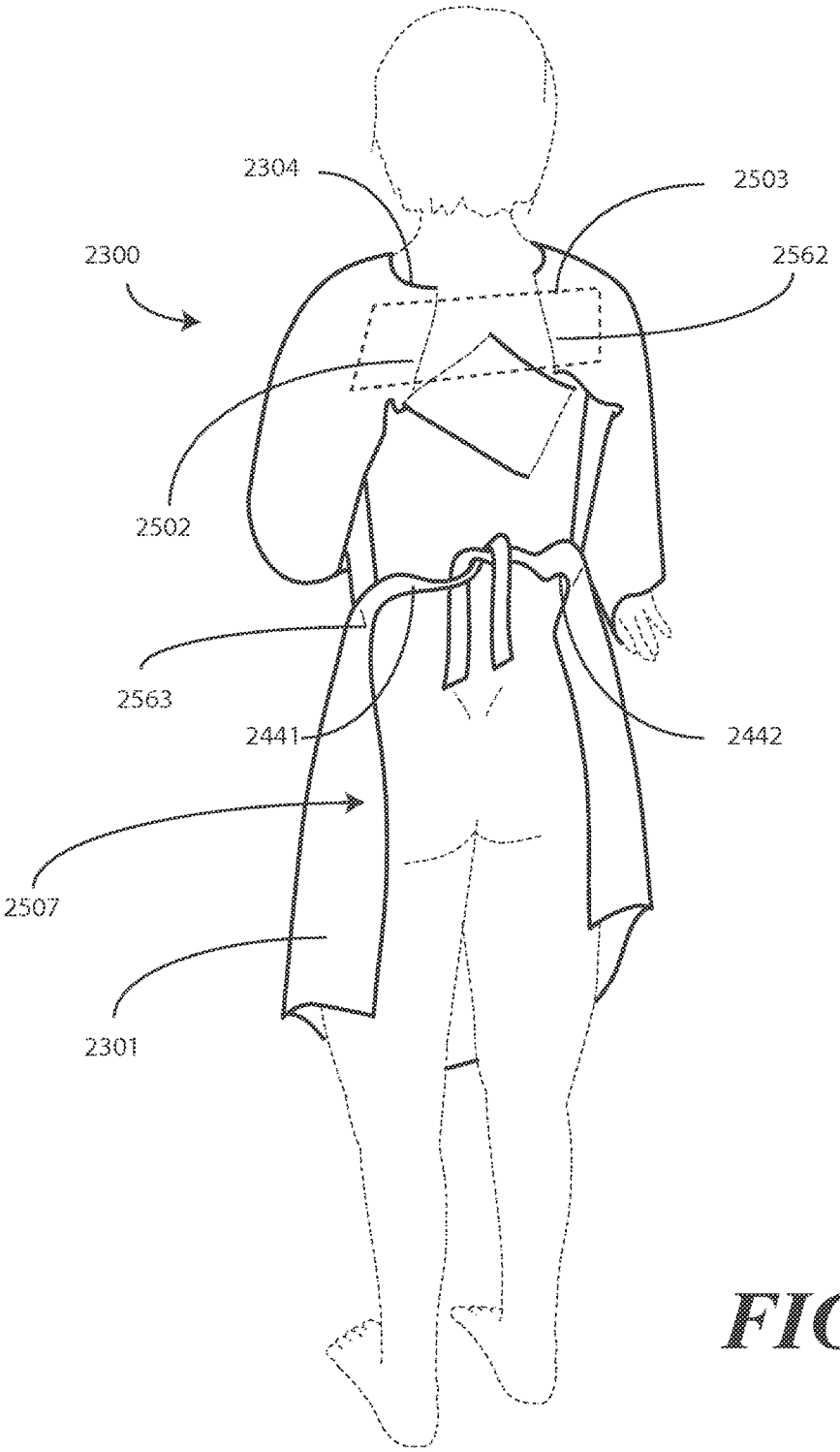
FIG. 25 illustrates a rear view of the user pulling on a front portion of another gown configured in accordance with one or more embodiments of the invention, thereby tearing a perforation to separate a rear portion of the gown.

Turning now to FIGS. 23-25, illustrated therein is a method of wearing and removing a gown 2300 in accordance with one or more embodiments of the invention. As shown in FIGS. 23 and 24, a user has accessed and donned the gown 2300. The user has passed her head through the neck opening 2404 and has tied the tie members 2441,2442 about her torso.

Turning now to FIG. 25, the user is now removing the gown 2300. Specifically, in this example she is using her left hand to grasp the front portion of the gown 2300. She then pulls it away from her torso. This causes the perforations 2502,2562 to tear, thereby splitting the rear portion 2503 of the gown 2300. This pulling action tears the perforations 2502,2562 and splits the rear portion 2503 between the neck opening 2304 and the opening 2501. The pulling action also separates the score 2563, thereby severing one or both tie members 2441,2442 from the body covering portion 2301, thereby facilitating simple removal of the gown 2300 with a simple stroke.

Figure 26:
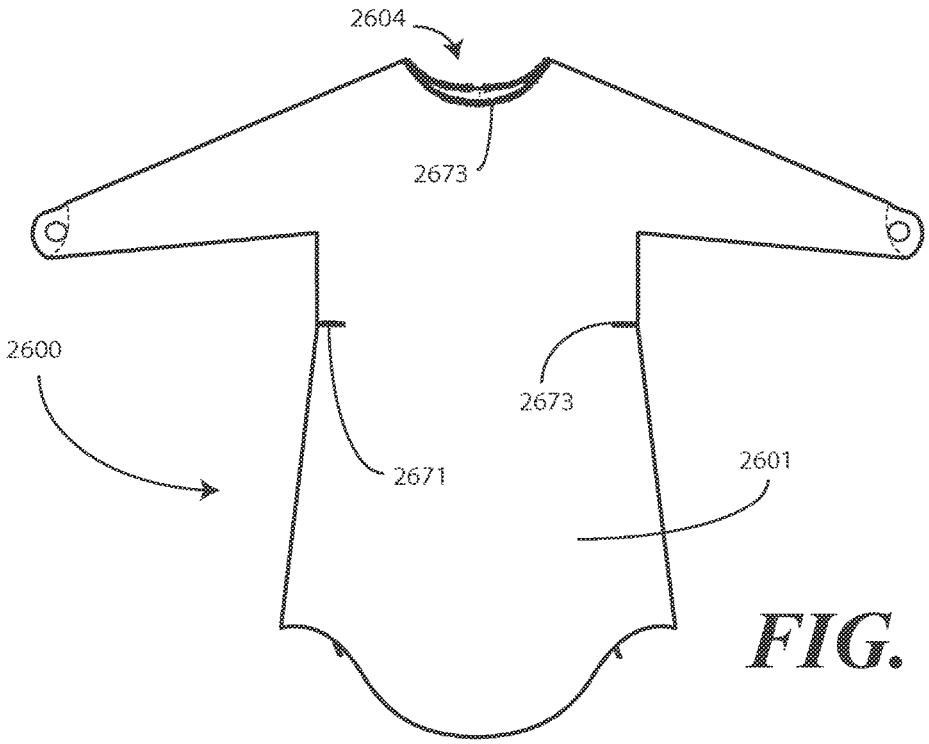
FIG. 26 illustrates a front view another example of a gown configured in accordance with one or more embodiments of the invention.
Figure 27:
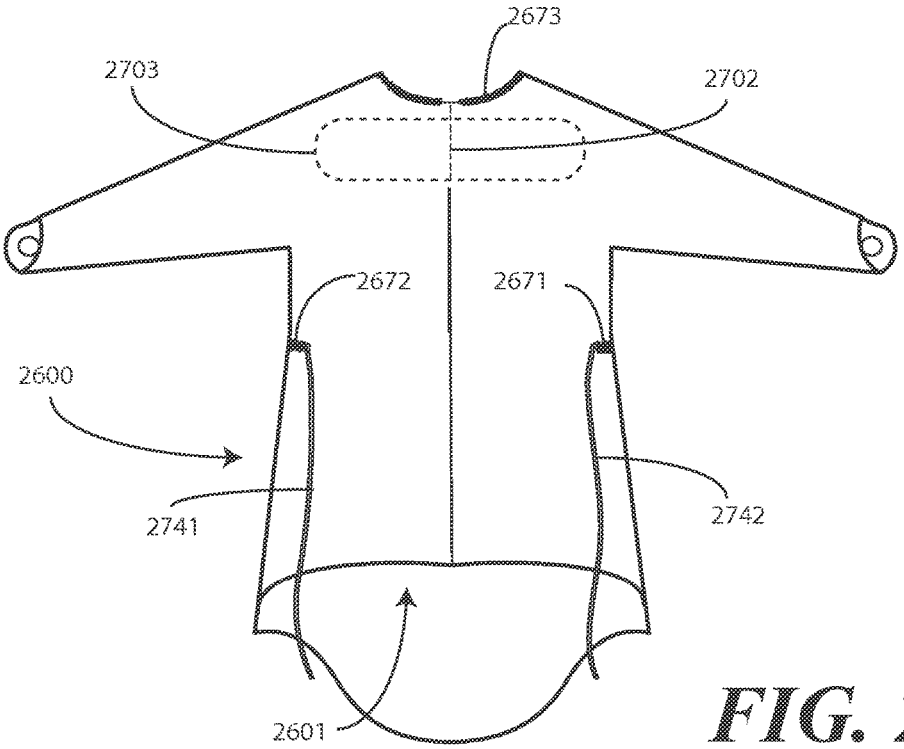
FIG. 27 illustrates a rear view of another example of a gown configured in accordance with one or more embodiments of the invention.

Turning now to FIGS. 26-27, illustrated therein is yet another embodiment of a gown 2600 configured in accordance with one or more embodiments of the invention. The gown 2600 of FIGS. 26-27 is similar to that of FIGS. 3 and 4. However, the gown 2600 of FIGS. 26-27 is configured with compliant gathering devices to help hold the gown 2600 more securely about the torso of the wearer.

Specifically, in this illustrative embodiment, the gown 2600 includes elastic gatherings, with an elastic gathering 2671,2672 being disposed at an attachment interface between a tie member 2741,2742 and the body covering portion 2601 of the gown 2600. In this configuration, the elastic gatherings are disposed so as to gather portions of the body covering portion 2601 about a waist of the wearer. In this illustrative embodiment, each elastic gathering is between about one and about three inches in length.

In one embodiment, the elastic gatherings 2671,2672 are integral with the body covering portion 2601, with any elastic or retractable material of the elastic gatherings 2671, 2672 being attached to the body covering portion 2601. In this embodiment, the tie members are attached to the body covering portion 2601, at or near the elastic gatherings 2671,2672, with only the tie members extending distally away from the body covering portion 2601. In this embodiment, the elastic gatherings 2671,2672 may be fully attached to the body covering portion 2601 such that they do not extend away from the body covering portion 2601.

In another embodiment, each elastic gathering 2671,2672 is integral with each tie member so as to form an axial extension of the tie member. Said differently, in this embodiment, only a portion of each elastic gathering 2671,2672 is attached to the body covering portion 2601, with the remainder of the elastic gathering 2671,2672 extending distally away from the body covering portion 2601. The elastic gatherings 2671,2672 can extend distally away from the body covering portion 2601 in an axial relationship with each tie member, such that when each tie member is pulled, it "stretches" away from the body covering portion 2601. Other embodiments will be obvious to those of ordinary skill in the art having the benefit of this disclosure.

The gown 2600 also includes an elastic strip 2673 disposed about at least a portion of the head insertion aperture 2604. In this illustrative embodiment, the elastic strip 2673 spans between 80 and 95 percent of the perimeter of the head insertion aperture 2604, stopping on either side of the perforation 2702 to allow easier separation of the rear portion 2703 when the perforation 2702 is torn. The elastic strip 2673 is accordingly configured to gather the head insertion aperture 2604 about a neck of the wearer.

Figure 28:
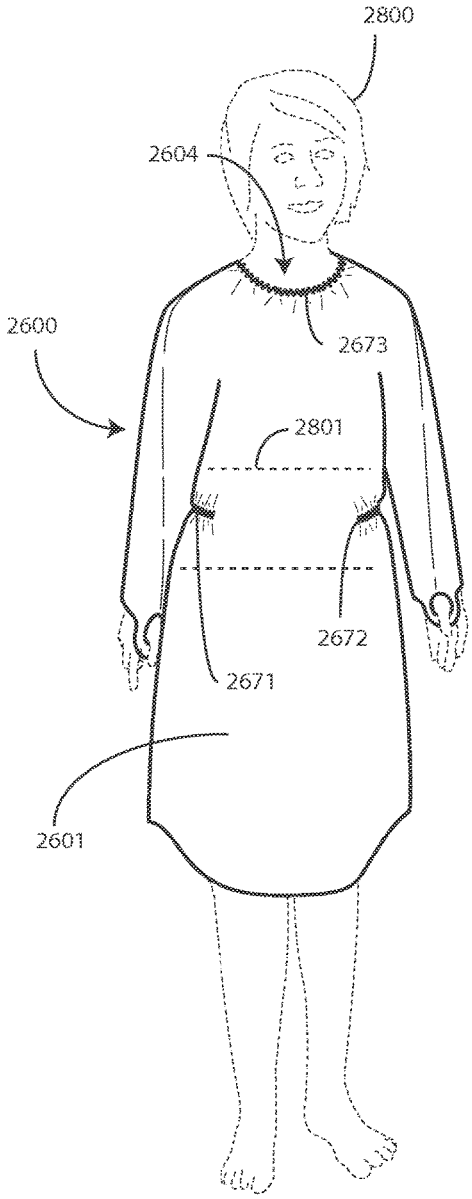
FIG. 28 illustrates another front view of a user wearing another example of a gown configured in accordance with one or more embodiments of the invention having tie members tied.
Figure 29:
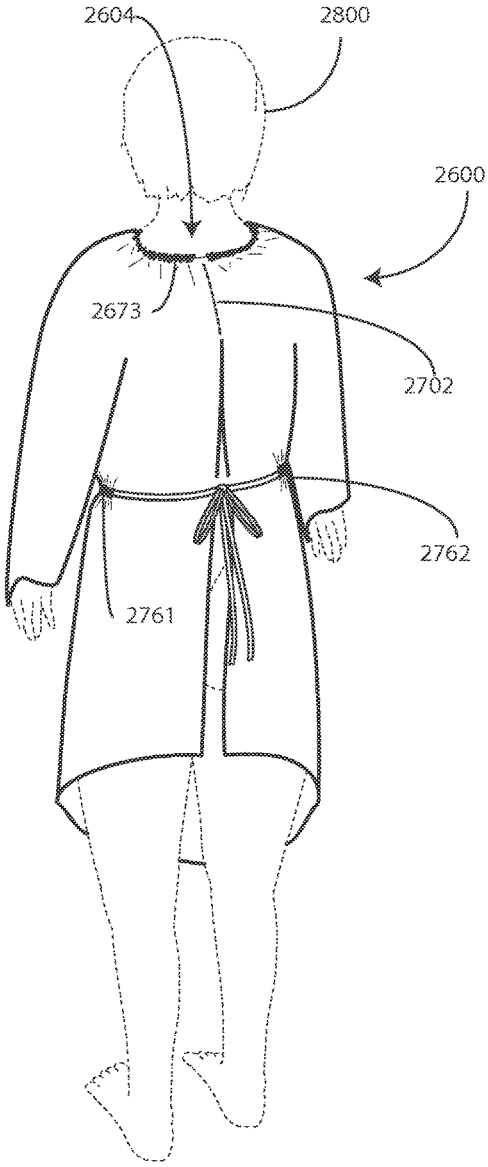
FIG. 29 illustrates another rear view of the user wearing another example of a gown configured in accordance with one or more embodiments of the invention having tie members tied.

Turning to FIGS. 28 and 29, illustrated therein is a user 2800 wearing the gown 2600. As shown, each elastic gathering 2671,2672 gathers portions of the body covering portion 2601 about a waist 2801 of the user 2800. Similarly, the elastic strip 2673 gathers the head insertion aperture 2604 about a neck of the user 2800, while still allowing the perforation 2702 to be torn when the user removes the gown 2600.

Figure 31:
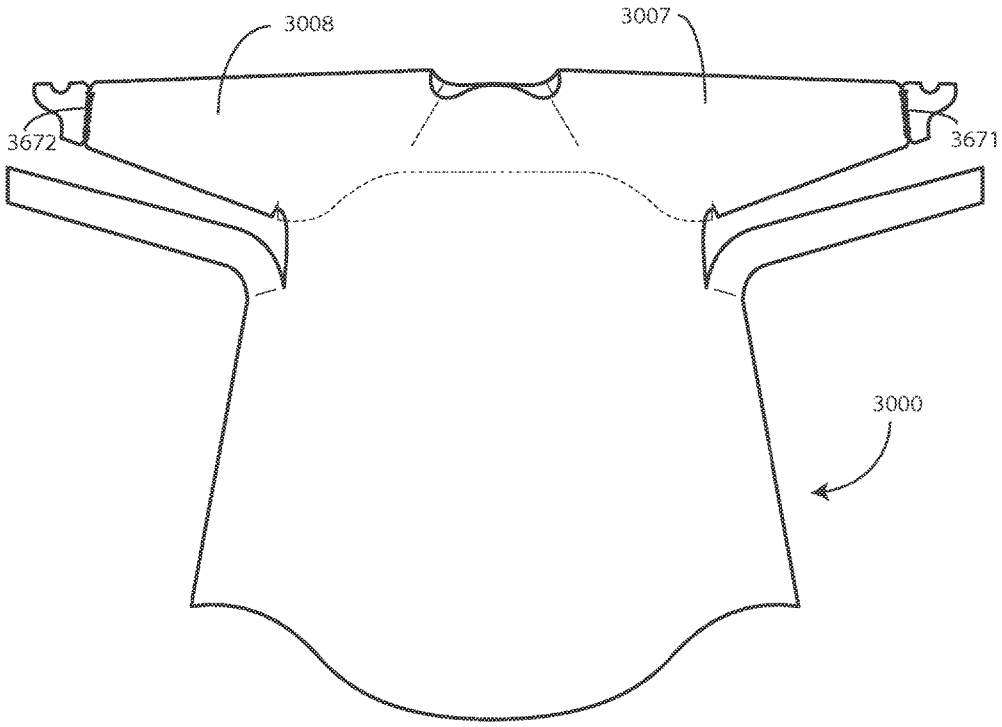
FIG. 31 illustrates a rear view of another example of a gown configured in accordance with one or more embodiments of the invention.

Turning now to FIGS. 30-31, illustrated therein is another gown 3000 configured in accordance with one or more embodiments of the invention. FIG. 30 illustrates a rear view of the gown 3000, while FIG. 31 illustrates a front view of the gown 3000. The gown 300 is similar to the gown (1600) shown in FIGS. 16-18. Elements that gown 3000 shares with the gown (1600) of FIGS. 16-18 will not be repeated in the description of gown 3000 for brevity.

A primary difference between the gown (1600) of FIGS. 16-18 and the gown 3000 of FIGS. 30-31 is that the arms 3007,3008 include elastic gatherings 3671,3672 about the wrists. Each elastic gathering 3671,3672 gathers portions of the arms 3007,3008 about a wrists of a user.

Figure 32:
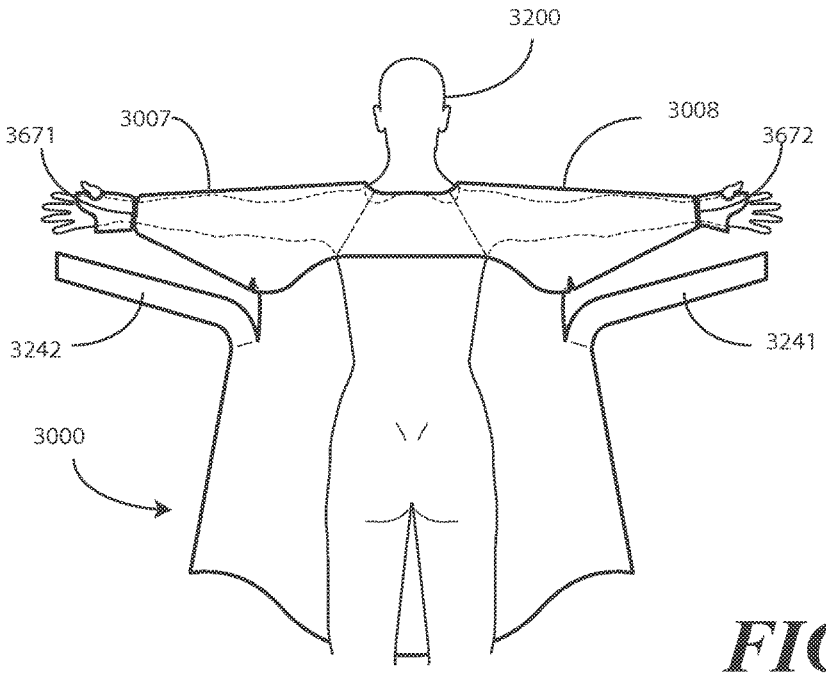
FIG. 32 illustrates a rear view of a user wearing another example of a gown configured in accordance with one or more embodiments of the invention prior to tying the tie members.
Figure 33:
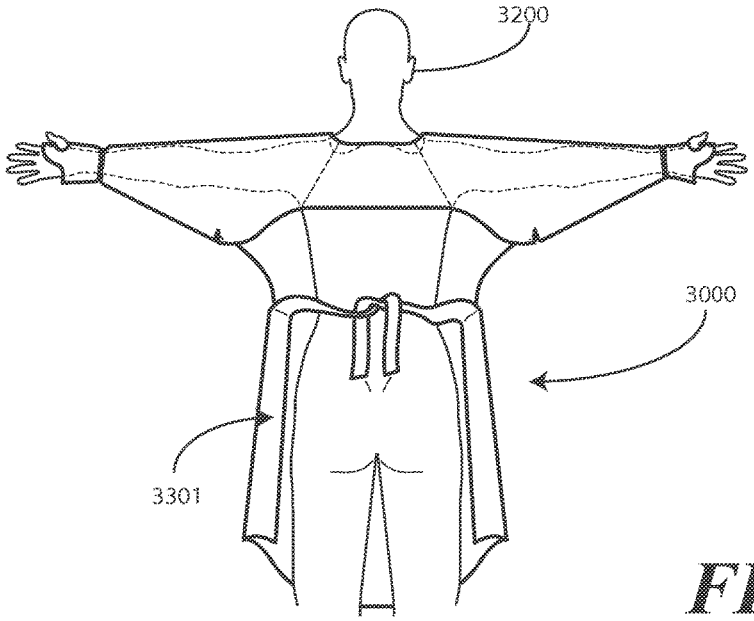
FIG. 33 illustrates a rear view of the user wearing another example of a gown configured in accordance with one or more embodiments of the invention after tying the tie members.

Turning now to FIGS. 32 and 33, a wearer 3200 can be seen donning the gown 3000 of FIGS. 30 and 31. Specifically, the wearer 3200 has inserted his head into the head insertion aperture. Also, the wearer has inserted his arms into the arm insertion apertures. The elastic gatherings 3671,3672 of the sleeves 3007,3008 gather the sleeves 3007,3008 about the wrists of the wearer 3200. The wearer 3200 has inserted his thumbs into the thumb loops. The combination of thumb loop and elastic gathering 3671,3672 work together to retain the sleeves 3007,3008 snugly along each arm. The tie members 3241,3242 are initially untied as shown in FIG. 32. Once tied, the tie members 3241,3242 cinch the body covering portion 3301 about the torso, as shown in FIG. 33.

Figure 34:
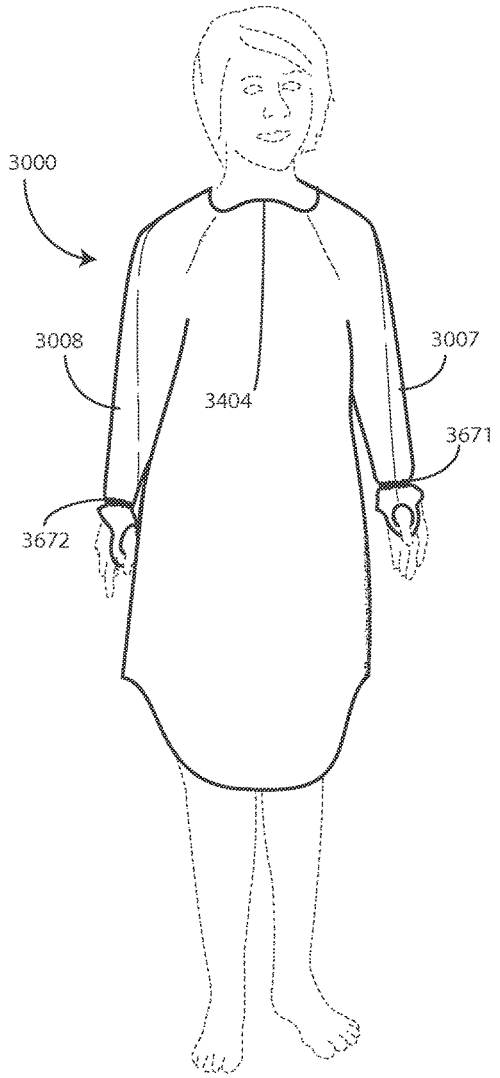
FIG. 34 illustrates another front view of a user wearing another example of a gown configured in accordance with one or more embodiments of the invention having tie members tied.
Figure 35:
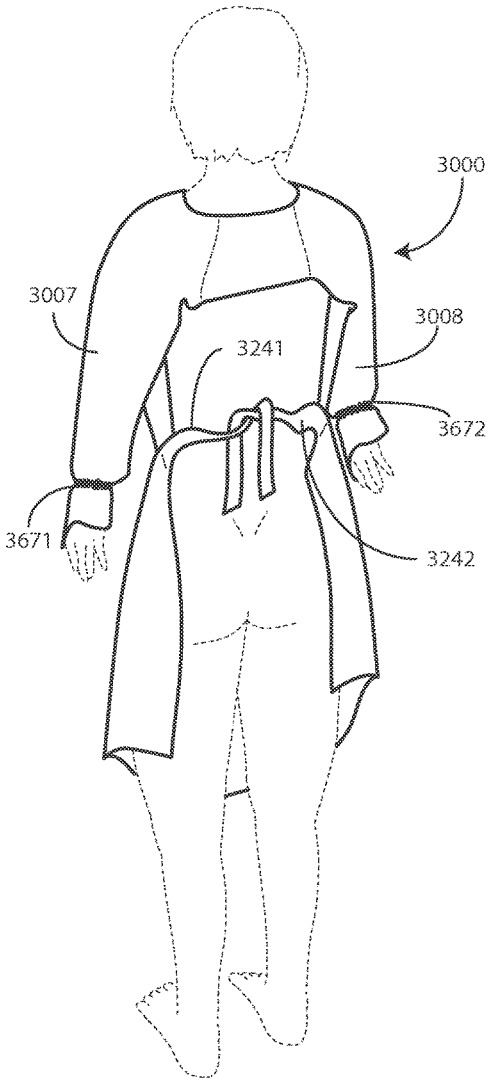
FIG. 35 illustrates another rear view of the user wearing another example of a gown configured in accordance with one or more embodiments of the invention having tie members tied.

Turning now to FIGS. 34-35, illustrated therein is a method of wearing and removing a gown 3000 in accordance with one or more embodiments of the invention. As shown in FIG. 34, a user has accessed and donned the gown 2300, with the elastic gatherings 3671,3672 gathering the sleeves 3007,3008 about her wrists. The user has passed her head through the neck opening 3404 and has tied the tie members 3241,3242 about her torso. The gown 3000 can then be removed in a manner similar to that described above with reference to FIG. 25.

Figure 36:
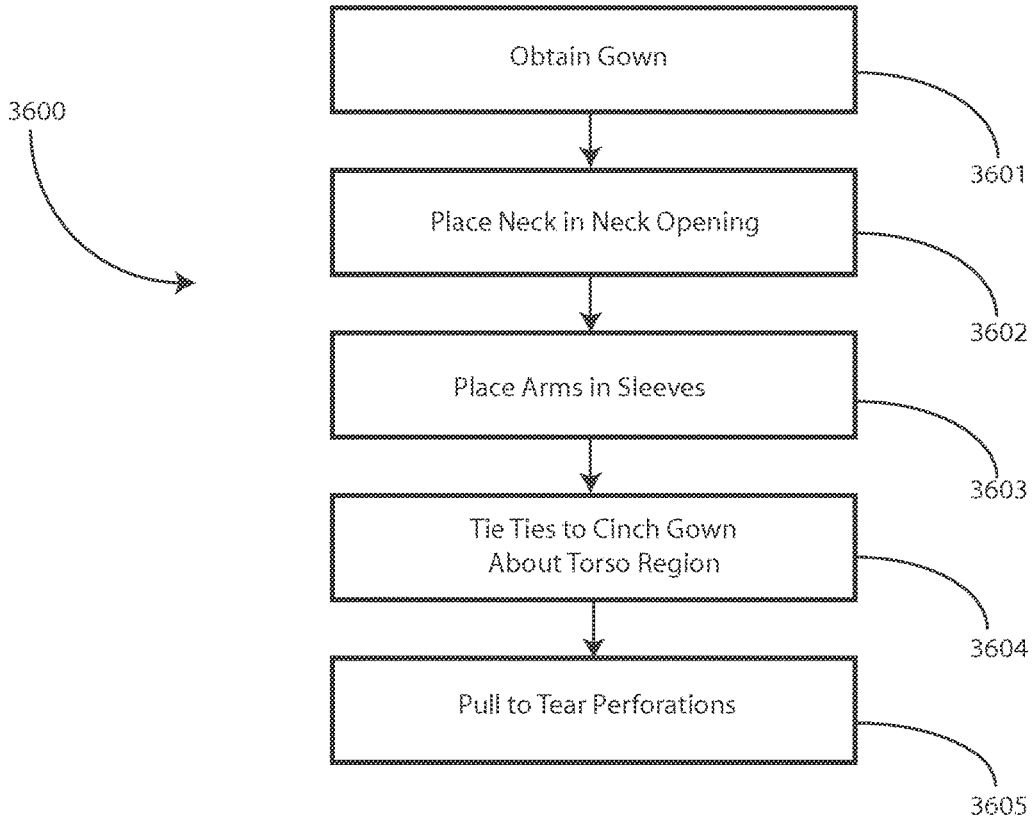
FIG. 36 illustrates one method of wearing and removing a gown in accordance with one or more embodiments of the invention.

Turning now to FIG. 36, illustrated therein is a flow chart of a method 3600 wearing and removing a gown suitable with various gown embodiments described above. At step 3601, a user accesses a gown configured in accordance with one of the embodiments above. As noted, the gown can include a non-woven fabric layer defining a neck opening between a portion and a rear portion, wherein the rear portion defines a torso opening. The gown can further include one or more perforations extending across the rear portion at least partially between the opening and the neck opening, and one or more tie members extending from the non-woven fabric layer.

At step 3602, the user places their head in the neck opening. At step 3603, the user places their arms in the sleeves. At step 3604, the user ties one or more tie members about their torso, thereby fully donning the gown.

To remove the gown, at step 3605, the user pulls the front portion of the material. In one embodiment, this pulling action tears the one or more perforations and splits the material between the neck opening and the opening. In one embodiment, this also severs one or more of the tie members from a body covering portion, thereby allowing the gown to be easily removed.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A gown, comprising:

a body covering portion configured to wrap about a torso of a wearer, the body covering portion comprising non-woven fabric layer defining a neck opening between a front portion and a rear portion of the body covering portion, wherein a front portion length of the body covering portion is greater than a rear portion length of the body covering portion, and the rear portion defines an opening configured to assist the wearer in donning the gown; and one or more perforations extending across the rear portion at least partially between the opening and the neck opening, the one or more perforations being configured to tear and split the rear portion when the front portion is pulled away from the user; and the rear portion of the body covering portion comprising a check indentation disposed at a rear underarm area; and the front portion comprising a loop in a front underarm area that is co-aligned with the check indentation.

2. The gown of claim 1, wherein the one or more perforations comprise at least two linear score lines, each linear score line comprising a plurality of perforations, with each of the plurality of perforations being arranged so as to extend along the rear portion, with each of the plurality of perforations adapted to diagonally cross at least parts of shoulder blades of a wearer.

3. The gown of claim 2, further comprising:

one or more sleeves extending distally away from an intersection of the front portion and the rear portion, each sleeve of the one or more sleeves defining an arm insertion aperture; and one or more additional perforations extending across the front portion, the one or more additional perforations extending diagonally between a head insertion aperture and the arm insertion aperture.

4. The gown of claim 3, wherein the one or more sleeves terminate with a thumb loop configured to engage a saddle of a thumb of the wearer.

5. The gown of claim 2, wherein the plurality of perforations comprises a plurality of scores separated by lengths of material.

6. The gown of claim 5, wherein the plurality of scores are each about one inch long, further wherein the lengths of material are each about one half inch long.

7. The gown of claim 6, wherein the plurality of scores comprises four scores.

8. The gown of claim 5, wherein the plurality of scores are each about three-quarters of an inch long, further wherein the lengths of material are each about one quarter inch long.

9. The gown of claim 8, wherein the plurality of scores comprises nine scores.

10. The gown of claim 1, further comprising one or more tie members, wherein the one or more tie members comprise a first tie member disposed on a first side of the opening and a second tie member disposed on a second side of the opening.

11. The gown of claim 10, wherein the one or more tie members each comprise a score line extending across a width portion of the one or more tie members at an interface of the one or more tie members with the non-woven fabric layer.

12. The gown of claim 11, wherein the score line is non-linear and measures between one and three inches.

13. The disposable medical gown of claim 1, the check indentation and the loop at least partially overlapping when the disposable medical gown is pressed flat.

* * * * *